US007590532B2

(12) United States Patent
Suzuki et al.

(10) Patent No.: US 7,590,532 B2
(45) Date of Patent: Sep. 15, 2009

(54) VOICE CODE CONVERSION METHOD AND APPARATUS

(75) Inventors: Masanao Suzuki, Kawasaki (JP); Yasuji Ota, Kawasaki (JP); Yoshiteru Tsuchinaga, Fukuoka (JP); Masakiyo Tanaka, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 920 days.

(21) Appl. No.: 10/307,869

(22) Filed: Dec. 2, 2002

(65) Prior Publication Data

US 2003/0142699 A1 Jul. 31, 2003

(30) Foreign Application Priority Data

Jan. 29, 2002 (JP) ..... 2002-019454

(51) Int. Cl.
*G10L 19/00* (2006.01)

(52) U.S. Cl. ..... 704/230; 704/207; 704/219

(58) Field of Classification Search ..... None
See application file for complete search history.

(56) References Cited

U.S. PATENT DOCUMENTS 5,764,298 A * 6/1998 Morrison ..... 348/500
5,884,252 A 3/1999 Ozawa
6,460,158 B1 * 10/2002 Baggen ..... 714/774
7,092,875 B2 * 8/2006 Tsuchinaga et al. ..... 704/210
2002/0077812 A1 * 6/2002 Suzuki et al. ..... 704/230

FOREIGN PATENT DOCUMENTS

JP 8-146997 6/1996
JP 8-328597 12/1996

OTHER PUBLICATIONS

Notification of Reasons for Refusal dated May 30, 2006.
Decision of Refusal dated Oct. 17, 2006.

* cited by examiner

*Primary Examiner*—Richemond Dorvil
*Assistant Examiner*—Leonard Saint Cyr
(74) *Attorney, Agent, or Firm*—Katten Muchin Rosenman LLP

(57) ABSTRACT

It is so arranged that a voice code can be converted even between voice encoding schemes having different subframe lengths. A voice code conversion apparatus demultiplexes a plurality of code components (Lsp1, Lag1, Gain1, Cb1), which are necessary to reconstruct a voice signal, from voice code in a first voice encoding scheme, dequantizes the codes of each of the components and converts the dequantized values of code components other than an algebraic code component to code components (Lsp2, Lag2, Gp2) of a voice code in a second voice encoding scheme. Further, the voice code conversion apparatus reproduces voice from the dequantized values, dequantizes codes that have been converted to codes in the second voice encoding scheme, generates a target signal using the dequantized values and reproduced voice, inputs the target signal to an algebraic code converter and obtains an algebraic code (Cb2) in the second voice encoding scheme.

1 Claim, 25 Drawing Sheets

FIG. 18 PRIOR ART

| PULSE SYSTEM | PULSE POSITION | POLARITY |
|---|---|---|
| 1 | 0, 5, 10, 15, 20, 25, 30, 35 | +/− |
| 2 | 1, 6, 11, 16, 21, 26, 31, 36 | +/− |
| 3 | 2, 7, 12, 17, 22, 27, 32, 37 | +/− |
| 4 | 3, 8, 13, 18, 23, 28, 33, 38<br>4, 9, 14, 19, 24, 29, 34, 39 | +/− |

VOICE CODE CONVERSION METHOD AND APPARATUS

BACKGROUND OF THE INVENTION

This invention relates to a voice code conversion method and apparatus for converting voice code obtained by encoding performed by a first voice encoding scheme to voice code of a second voice encoding scheme. More particularly, the invention relates to a voice code conversion method and apparatus for converting voice code, which has been obtained by encoding voice by a first voice encoding scheme used over the Internet or by a cellular telephone system, etc., to voice code of a second encoding scheme that is different from the first voice encoding scheme.

There has been an explosive increase in subscribers to cellular telephones in recent years and it is predicted that the number of such users will continue to grow in the future. Voice communication using the Internet (Voice over IP, or VoIP) is coming into increasingly greater use in intracorporate IP networks (intranets) and for the provision of long-distance telephone service. In voice communication systems such as cellular telephone systems and VoIP, use is made of voice encoding technology for compressing voice in order to utilize the communication channel effectively.

In the case of cellular telephones, the voice encoding technology used differs depending upon the country or system. With regard to cdma 2000 expected to be employed as the next-generation cellular telephone system, EVRC (Enhanced Variable-Rate Codec) has been adopted as a voice encoding scheme. With VoIP, on the other hand, a scheme compliant with ITU-T Recommendation G.729A is being used widely as the voice encoding method. An overview of G.729A and EVRC will be described first.

(1) Description of G.729A

Encoder Structure and Operation

FIG. 15 is a diagram illustrating the structure of an encoder compliant with ITU-T Recommendation G.729A. As shown in FIG. 15, input signals (speech signals) X of a predetermined number (=N) of samples per frame are input to an LPC (Linear Prediction Coefficient) analyzer 1 frame by frame. If the sampling speed is 8 kHz and the length of a single frame is 10 ms, then one frame will be composed of 80 samples. The LPC analyzer 1, which is regarded as an all-pole filter represented by the following equation, obtains filter coefficients $\alpha i$ (i=1, . . . P), here P represents the order of the filter:

$$H(z)=1/[1+\Sigma\alpha i\cdot z^{-i}]\ (i=1 \text{ to } P) \tag{1}$$

Generally, in the case of voice in the telephone band, a value of 10 to 12 is used as P. The LPC analyzer 1 performs LPC analysis using 80 samples of the input signal, 40 pre-read samples and 120 past signal samples, for a total of 240 samples, and obtains the LPC coefficients.

A parameter converter 2 converts the LPC coefficients to LSP (Line Spectrum Pair) parameters. An LSP parameter is a parameter of a frequency region in which mutual conversion with LPC coefficients is possible. Since a quantization characteristic is superior to LPC coefficients, quantization is performed in the LSP domain. An LSP quantizer 3 quantizes an LSP parameter obtained by the conversion and obtains an LSP code and an LSP dequantized value. An LSP interpolator 4 obtains an LSP interpolated value from the LSP dequantized value found in the present frame and the LSP dequantized value found in the previous frame. More specifically, one frame is divided into two subframes, namely first and second subframes, of 5 ms each, and the LPC analyzer 1 determines the LPC coefficients of the second subframe but not of the first subframe. Using the LSP dequantized value found in the present frame and the LSP dequantized value found in the previous frame, the LSP interpolator 4 predicts the LSP dequantized value of the first subframe by interpolation.

A parameter deconverter 5 converts the LSP dequantized value and the LSP interpolated value to LPC coefficients and sets these coefficients in an LPC synthesis filter 6. In this case, the LPC coefficients converted from the LSP interpolated values in the first subframe of the frame and the LPC coefficients converted from the LSP dequantized values in the second subframe are used as the filter coefficients of the LPC synthesis filter 6. In the description that follows, the "l" in items having an index attached to the "l", e.g., lspi, $li^{(n)}$, . . . , is the letter "l" in the alphabet.

After LSP parameters lspi (i=1, . . . , P) are quantized by scalar quantization or vector quantization in the LSP quantizer 3, the quantization indices (LSP codes) are sent to the decoder side. FIG. 16 is a diagram useful in describing the quantization method. Here sets of large numbers of quantization LSP parameters have been stored in a quantization table 3*a* in correspondence with index numbers 1 to n. A distance calculation unit 3*b* calculates distance in accordance with the following equation:

$$d=\sum_i\{lsp_q(i)-lspi\}^2(i=1\sim P)$$

When q is varied from 1 to n, a minimum-distance index detector 3*c* finds the q for which the distance d is minimized and sends the index q to the decoder side as an LSP code.

Next, sound-source and gain search processing is executed. Sound source and gain are processed on a per-subframe basis. First, a sound-source signal is divided into a pitch-period component and a noise component, an adaptive codebook 7 storing a sequence of past sound-source signals is used to quantize the pitch-period component and an algebraic codebook or noise codebook is used to quantize the noise component. Described below will be voice encoding using the adaptive codebook 7 and an algebraic codebook 8 as sound-source codebooks.

The adaptive codebook 7 is adapted to output N samples of sound-source signals (referred to as "periodicity signals"), which are delayed successively by one sample, in association with indices 1 to L. FIG. 17 is a diagram showing the structure of the adaptive codebook 7 in the case of a subframe of 40 samples (N=40). The adaptive codebook is constituted by a buffer BF for storing the pitch-period component of the latest (L+39) samples. A periodicity signal comprising 1 to 40 samples is specified by index 1, a periodicity signal comprising 2 to 41 samples is specified by index 2, . . . , and a periodicity signal comprising L to L+39 samples is specified by index L. In the initial state, the content of the adaptive codebook 7 is such that all signals have amplitudes of zero. Operation is such that a subframe length of the oldest signals is discarded subframe by subframe so that the sound-source signal obtained in the present frame will be stored in the adaptive codebook 7.

An adaptive-codebook search identifies the periodicity component of the sound-source signal using the adaptive codebook 7 storing past sound-source signals. That is, a subframe length (=40 samples) of past sound-source signals in the adaptive codebook 7 are extracted while changing, one sample at a time, the point at which read-out from the adaptive codebook 7 starts, and the sound-source signals are input to the LPC synthesis filter 6 to create a pitch synthesis signal $\beta AP_L$, where $P_L$ represents a past periodicity signal (adaptive code vector), which corresponds to delay L, extracted from the adaptive codebook 7, A the impulse response of the LPC synthesis filter 6, and β the gain of the adaptive codebook.

An arithmetic unit 9 finds an error power $E_L$ between the input voice X and $\beta AP_L$ in accordance with the following equation:

$$E_L=|X-\beta AP_L|^2 \tag{2}$$

If we let $AP_L$ represent a weighted synthesized output from the adaptive codebook, Rpp the autocorrelation of $AP_L$ and Rxp the cross-correlation between $AP_L$ and the input signal X, then an adaptive code vector $P_L$ at a pitch lag Lopt for which the error power of Equation (2) is minimum will be expressed by the following equation:

$$P_L=\arg\max(Rxp^2/Rpp) \tag{3}$$

That is, the optimum starting point for read-out from the codebook is that at which the value obtained by normalizing the cross-correlation Rxp between the pitch synthesis signal $AP_L$ and the input signal X by the autocorrelation Rpp of the pitch synthesis signal is largest. Accordingly, an error-power evaluation unit 10 finds the pitch lag Lopt that satisfies Equation (3). Optimum pitch gain βopt is given by the following equation:

$$\beta opt=Rxp/Rpp \tag{4}$$

Next, the noise component contained in the sound-source signal is quantized using the algebraic codebook 8. The latter is constituted by a plurality of pulses of amplitude 1 or −1. By way of example, FIG. 18 illustrates pulse positions for a case where frame length is 40 samples. The algebraic codebook 8 divides the N (=40) sampling points constituting one frame into a plurality of pulse-system groups 1 to 4 and, for all combinations obtained by extracting one sampling point from each of the pulse-system groups, successively outputs, as noise components, pulsed signals having a +1 or a −1 pulse at each sampling point. In this example, basically four pulses are deployed per frame. FIG. 19 is a diagram useful in describing sampling points assigned to each of the pulse-system groups 1 to 4.

(1) Eight sampling points 0, 5, 10, 15, 20, 25, 30, 35 are assigned to the pulse-system group 1;

(2) eight sampling points 1, 6, 11, 16, 21, 26, 31, 36 are assigned to the pulse-system group 2;

(3) eight sampling points 2, 7, 12, 17, 22, 27, 32, 37 are assigned to the pulse-system group 3; and (4) 16 sampling points 3, 4, 8, 9, 13, 14, 18, 19, 23, 24, 28, 29, 33, 34, 38, 39 are assigned to the pulse-system group 4.

Three bits are required to express the sampling points in pulse-system groups 1 to 3 and one bit is required to express the sign of a pulse, for a total of four bits. Further, four bits are required to express the sampling points in pulse-system group 4 and one bit is required to express the sign of a pulse, for a total of five bits. Accordingly, 17 bits are necessary to specify a pulsed signal output from the noise codebook 8 having the pulse placement of FIG. 18, and $2^{17}$ types of pulsed signals exist.

The pulse positions of each of the pulse systems are limited, as illustrated in FIG. 18. In the algebraic codebook search, a combination of pulses for which the error power relative to the input voice is minimized in the reconstruction region is decided from among the combinations of pulse positions of each of the pulse systems. More specifically, with βopt as the optimum pitch gain found by the adaptive-codebook search, the output $P_L$ of the adoptive codebook is multiplied by βopt and the product is input to an adder 11. At the same time, the pulsed signals are input successively to the adder 11 from the algebraic codebook 8 and a pulsed signal is specified that will minimize the difference between the input signal X and a reproduced signal obtained by inputting the adder output to the LPC synthesis filter 6. More specifically, first a target vector X' for an algebraic codebook search is generated in accordance with the following equation from the optimum adaptive codebook output $P_L$ and optimum pitch gain βopt obtained from the input signal X by the adaptive-codebook search:

$$X'=X-\beta optAP_L \tag{5}$$

In this example, pulse position and amplitude (sign) are expressed by 17 bits and therefore $2^{17}$ combinations exist. Accordingly, letting $C_K$ represent a kth algebraic-code output vector, a code vector $C_K$ that will minimize an evaluation-function error power D in the following equation is found by a search of the algebraic codebook:

$$D=|X'-G_cAC_K|^2 \tag{6}$$

where $G_c$ represents the gain of the algebraic codebook. In the algebraic codebook search, the error-power evaluation unit 10 searches for the combination of pulse position and polarity that will afford the largest normalized cross-correlation value (Rcx*Rcx/Rcc) obtained by normalizing the square of a cross-correlation value Rcx between an algebraic synthesis signal $AC_K$ and input signal X' by an autocorrelation value Rcc of the algebraic synthesis signal. The result output from the algebraic codebook search is the position and sign (positive or negative) of each pulse. These results shall be referred to collectively as algebraic code.

Gain quantization will be described next. With the G.729A system, algebraic codebook gain is not quantized directly. Rather, the adaptive codebook gain $G_a$ (=βopt) and a correction coefficient γ of the algebraic codebook gain $G_c$ are vector quantized. The algebraic codebook gain $G_c$ and the correction coefficient y are related as follows:

$$G_c=g'\times\gamma$$

where g' represents the gain of the present frame predicted from the logarithmic gains of the four past subframes.

A gain quantizer 12 has a gain quantization table (gain codebook), not shown, for which there are prepared 128 (=$2^7$) combinations of adaptive codebook gain $G_a$ and correction coefficients γ for algebraic codebook gain. The method of the gain codebook search includes ① extracting one set of table values from the gain quantization table with regard to an output vector from the adaptive codebook and an output vector from the algebraic codebook and setting these values in gain varying units 13, 14, respectively; ② multiplying these vectors by gains $G_a$, $G_c$ using the gain varying units 13, 14, respectively, and inputting the products to the LPC synthesis filter 6; and ③ selecting, by way of the error-power evaluation unit 10, the combination for which the error power relative to the input signal X is minimized.

A channel encoder 15 creates channel data by multiplexing ① an LSP code, which is the quantization index of the LSP, ② a pitch-lag code Lopt, ③ an algebraic code, which is an algebraic codebook index, and ④ a gain code, which is a quantization index of gain. The channel encoder 15 sends this channel data to a decoder.

Thus, as described above, the G.729A encoding system produces a model of the speech generation process, quantizes the characteristic parameters of this model and transmits the parameters, thereby making it possible to compress speech efficiently.

Decoder Structure and Operation

FIG. 20 is a block diagram illustrating a G.729A-compliant decoder. Channel data sent from the encoder side is input to a channel decoder 21, which proceeds to output an LSP code, pitch-lag code, algebraic code and gain code. The decoder decodes voice data based upon these codes. The operation of the decoder will now be described, though parts of the description will be redundant because functions of the decoder are included in the encoder.

Upon receiving the LSP code as an input, an LSP dequantizer 22 applies dequantization and outputs an LSP dequantized value. An LSP interpolator 23 interpolates an LSP dequantized value of the first subframe of the present frame from the LSP dequantized value in the second subframe of the present frame and the LSP dequantized value in the second subframe of the previous frame. Next, a parameter deconverter 24 converts the LSP interpolated value and the LSP dequantized value to LPC synthesis filter coefficients. A G.729A-compliant synthesis filter 25 uses the LPC coefficient converted from the LSP interpolated value in the initial first subframe and uses the LPC coefficient converted from the LSP dequantized value in the ensuing second subframe.

An adaptive codebook 26 outputs a pitch signal of subframe length (=40 samples) from a read-out starting point specified by a pitch-lag code, and a noise codebook 27 outputs a pulse position and pulse polarity from a read-out position that corresponds to an algebraic code. A gain dequantizer 28 calculates an adaptive codebook gain dequantized value and an algebraic codebook gain dequantized value from the gain code applied thereto and sets these vales in gain varying units 29, 30, respectively. An adder 31 creates a sound-source signal by adding a signal, which is obtained by multiplying the output of the adaptive codebook by the adaptive codebook gain dequantized value, and a signal obtained by multiplying the output of the algebraic codebook by the algebraic codebook gain dequantized value. The sound-source signal is input to an LPC synthesis filter 25. As a result, reconstructed speech can be obtained from the LPC synthesis filter 25.

In the initial state, the content of the adaptive codebook 26 on the decoder side is such that all signals have amplitudes of zero. Operation is such that a subframe length of the oldest signals is discarded subframe by subframe so that the sound-source signal obtained in the present frame will be stored in the adaptive codebook 26. In other words, the adaptive codebook 7 of the encoder and the adaptive codebook 26 of the decoder are always maintained in the identical, latest state.

(2) Description of EVRC

EVRC is characterized in that the number of bits transmitted per frame is varied in dependence upon the nature of the input signal. More specifically, bit rate is raised in steady segments such as vowel segments and the number of transmitted bits is lowered in silent or transient segments, thereby reducing the average bit rate over time. EVRC bit rates are shown in Table 1.

TABLE 1

| MODE | BIT RATE bits/frame | BIT RATE kbits/s | VOICE SEGMENT OF INTEREST |
|---|---|---|---|
| FULL RATE | 171 | 8.55 | STEADY SEGMENT |
| HALF RATE | 80 | 4.0 | VARIABLE SEGMENT |
| ⅛ RATE | 16 | 0.8 | SILENT SEGMENT |

With EVRC, the rate of the input signal of the present frame is determined. The rate determination involves dividing the frequency region of an input speech signal into high and low regions and calculating power in each region, comparing the power values of each of these regions with two predetermined threshold values, selecting the full rate if the low-region power and the high-region power exceed the threshold values, selecting the half rate if only the low-region power or high-region power exceeds the threshold value, and selecting the ⅛ rate if the low- and high-region power values are both lower than the threshold values.

FIG. 21 illustrates the structure of an EVRC encoder. With EVRC, an input signal that has been segmented into 20-ms frames (160 samples) is input to an encoder. Further, one frame of the input signal is segmented into three subframes, as indicated in Table 2 below. It should be noted that the structure of the encoder is substantially the same in the case of both full rate and half rate, and that only the numbers of quantization bits of the quantizers differ between the two. The description rendered below, therefore, will relate to the full-rate case.

TABLE 2

| SUBFRAME NO. | | 1 | 2 | 3 |
|---|---|---|---|---|
| SUBFRAME LENGTH | NUMBER OF SAMPLES | 53 | 53 | 54 |
| | MILLISECONDS | 6.625 | 6.625 | 6.750 |

As shown in FIG. 22, an LPC (Linear Prediction Coefficient) analyzer 41 obtains LPC coefficients by LPC analysis using 160 samples of the input signal of the present frame and 80 samples of the pre-read segment, for a total of 240 samples. An LSP quantizer 42 converts the LPC coefficients to LSP parameters and then performs quantization to obtain LSP code. An LSP dequantizer 43 obtains an LSP dequantized value from the LSP code. Using the LSP dequantized value found in the present frame (the LSP dequantized value of the third subframe) and the LSP dequantized value found in the previous frame, an LSP interpolator 44 predicts the LSP dequantized value of the $0^{th}$, $1^{st}$ and $2^{nd}$ subframes of the present frame by linear interpolation.

Next, a pitch analyzer 45 obtains the pitch lag and pitch gain of the present frame. According to EVRC, pitch analysis is performed twice per frame. The position of the analytical window of pitch analysis is as shown in FIG. 22. The procedure of pitch analysis is as follows:

(1) The input signal of the present frame and the pre-read signal are input to an LPC inverse filter composed of the above-mentioned LPC coefficients, whereby an LPC residual signal is obtained. If H(z) represents the LPC synthesis filter, then the LPC inverse filter is 1/H(z).

(2) The autocorrelation function of the LPC residual filter is found, and the pitch lag and pitch gain for which the autocorrelation function will be maximized are obtained.

(3) The above-described processing is executed at two analytical window positions. Let Lag1 and Gain1 represent the pitch lag and pitch gain found by the first analysis, respectively, and let Lag2 and Gain2 represent the pitch lag and pitch gain found by the second analysis, respectively.

(4) When the difference between Gain1 and Gain2 is equal to or greater than a predetermined threshold value, Gain1 and Lag1 are adopted as the pitch gain and pitch lag, respectively, of the present frame. When the difference between Gain1 and Gain2 is less than the predetermined threshold value, Gain2 and Lag2 are adopted as the pitch gain and pitch lag, respectively, of the present frame.

The pitch lag and pitch gain are found by the above-described procedure. A pitch-gain quantizer 46 quantizes the pitch gain using a quantization table and outputs pitch-gain code. A pitch-gain dequantizer 47 dequantizes the pitch-gain code and inputs the result to a gain varying unit 48. Whereas pitch lag and pitch gain are obtained on a per-subframe basis with G.729A, EVRC differs in that pitch lag and pitch gain are obtained on a per-frame basis.

Further, EVRC differs in that an input-voice correction unit 49 corrects the input signal in dependence upon the pitch-lag code. That is, rather than finding the pitch lag and pitch gain for which error relative to the input signal is smallest, as is done in accordance with G.729A, the input-voice correction unit 49 in EVRC corrects the input signal in such a manner that it will approach closest to the output of the adaptive codebook decided by the pitch lag and pitch gain found by pitch analysis. More specifically, the input-voice correction unit 49 converts the input signal to a residual signal by an LPC inverse filter and time-shifts the position of the pitch peak in the region of the residual signal in such a manner that the position will be the same as the pitch-peak position in the output of an adaptive codebook 47.

Next, a noise-like sound-source signal and gain are decided on a per-subframe basis. First, an adaptive-codebook synthesized signal obtained by passing the output of an adaptive codebook 50 through the gain varying unit 48 and an LPC synthesis filter 51 is subtracted from the corrected input signal, which is output from the input-voice correction unit 49, by an arithmetic unit 52, thereby generating a target signal X' of an algebraic codebook search. An EVRC adaptive codebook 53 is composed of a plurality of pulses, in a manner similar to that of G.729A, and 35 bits per subframe are allocated in the full-rate case. Table 3 below illustrates the full-rate pulse positions.

TABLE 3

EVRC ALGEBRAIC CODEBOOK (FULL RATE)

| PULSE SYSTEM | PULSE POSITION | POLARITY |
|---|---|---|
| T0 | 0, 5, 10, 15, 20, 25, 30, 35, 40, 45, 50 | +/− |
| T1 | 1, 6, 11, 16, 21, 26, 31, 36, 41, 46, 51 | +/− |
| T2 | 2, 7, 12, 17, 22, 27, 32, 37, 42, 47, 52 | +/− |
| T3 | 3, 8, 13, 18, 23, 28, 33, 38, 43, 48, 53 | +/− |
| T4 | 4, 9, 14, 19, 24, 29, 34, 39, 44, 49, 54 | +/− |

The method of searching the algebraic codebook is similar to that of G.729A, though the number of pulses selected from each pulse system differs. Two pulses are assigned to three of the five pulse systems, and one pulse is assigned to two of the five pulse systems. Combinations of systems that assign one pulse are limited to four, namely T3-T4, T4-T0, T0-T1 and T1-T2. Accordingly, combinations of pulse systems and pulse numbers are as shown in Table 4 below.

TABLE 4

PULSE-SYSTEM COMBINATIONS

| | ONE-PULSE SYSTEMS | TWO-PULSE SYSTEMS |
|---|---|---|
| (1) | T3, T4 | T0, T1, T2 |
| (2) | T4, T0 | T1, T2, T3 |
| (3) | T0, T1 | T2, T3, T4 |
| (4) | T1, T2 | T3, T4, T0 |

Thus, since there are systems that assign one pulse and systems that assign two pulses, the number of bits allocated to each pulse system differs depending upon the number of pulses. Table 5 below indicates the bit distribution of the algebraic codebook in the full-rate case.

TABLE 5

BIT DISTRIBUTION OF EVRC ALGEBRAIC CODEBOOK

| NUMBER OF PULSES | INFORMATION | BIT DISTRIBUTION |
|---|---|---|
| ONE PULSE | COMBINATIONS | 2 BITS (FOUR) |
| | PULSE POSITIONS | 7 BITS (11 × 11) = 121 < 128 |
| | POLARITY | 2 BITS |
| TWO PULSES | PULSE POSITIONS | 21 BITS (7 × 3) |
| | POLARITY (SAME AS THAT OF ONE-PULSE SYSTEM | 3 BITS (3 × 1) |
| | TOTAL | 35 BITS |

Since combinations of one-pulse systems are four in number, two bits are necessary. If 11 pulse positions in two pulse systems in which the number of pulses is one are arrayed in the X and Y directions, an 11×11 grid can be formed and a pulse position in the two pulse systems can be specified by one grid point. Accordingly, seven bits are necessary to specify a pulse position in two pulse systems in which the number of pulses is one, and two bits are necessary to express the polarity of a pulse in two pulse systems in which the number of pulses is one. Further, 7×3 bits are necessary to specify a pulse position in three pulse systems in which the number of pulses is two, and 1×3 bits are necessary to express the polarity of a pulse in three pulse systems in which the number of pulses is two. It should be noted that the polarity of pulses in the one-pulse systems is the same. Thus, in EVRC, an algebraic codebook can be expressed by a total of 35 bits.

In the algebraic codebook search, the algebraic codebook 53 generates an algebraic synthesis signal by successively inputting pulsed signals to a gain multiplier 54 and LPC synthesis filter 55, and an arithmetic unit 56 calculates the difference between the algebraic synthesis signal and target signal X' and obtains the code vector Ck that will minimize the evaluation-function error power D in the following equation:

$$D=|X'-G_cAC_K|^2$$

where $G_c$ represents the gain of the algebraic codebook. In the algebraic codebook search, an error-power evaluation unit 59 searches for the combination of pulse position and polarity that will afford the largest normalized cross-correlation value (Rcx*Rcx/Rcc) obtained by normalizing the square of a cross-correlation value Rcx between the algebraic synthesis signal $AC_K$ and target signal X' by an autocorrelation value Rcc of the algebraic synthesis signal.

Algebraic codebook gain is not quantized directly. Rather, the correction coefficient γ of the algebraic codebook gain is scalar quantized by five bits per subframe. The correction coefficient γ is a value (γ=Gc/g') obtained by normalizing algebraic codebook gain Gc by g', where g' represents gain predicted from past subframes.

A channel multiplexer 60 creates channel data by multiplexing ① an LSP code, which is the quantization index of the LSP, ② a pitch-lag code, ③ an algebraic code, which is an algebraic codebook index, ④ a pitch-gain code, which is the quantization index of the pitch gain, and ⑤ an algebraic codebook gain code, which is the quantization index of algebraic codebook gain. The multiplexer 60 sends the channel data to a decoder.

It should be noted that the decoder is so adapted as to decode the LSP code, pitch-lag code, algebraic code, pitch-gain code and algebraic codebook gain code sent from the encoder. The EVRC decoder can be created in a manner similar to that in which a G.729 decoder is created to deal with a G.729 encoder. The EVRC decoder, therefore, need not be described here.

(3) Conversion of Voice Code According to the Prior Art

It is believed that the growing popularity of the Internet and cellular telephones will lead to ever increasing voice traffic by Internet users and users of cellular telephone networks. However, communication between a cellular telephone network and the Internet cannot take place if a voice encoding scheme used by the cellular telephone network and a voice encoding scheme used by the Internet differ.

FIG. 30 is a diagram showing the principle of a typical voice code conversion method according to the prior art. This method shall be referred to as "prior art 1" below. This example takes into consideration only a case where voice input to a terminal 71 by a user A is sent to a terminal 72 of a user B. It is assumed here that the terminal 71 possessed by user A has only an encoder 71*a* of an encoding scheme 1 and that the terminal 72 of user B has only a decoder 72*a* of an encoding scheme 2.

Voice that has been produced by user A on the transmitting side is input to the encoder 71*a* of encoding scheme 1 incorporated in terminal 71. The encoder 71*a* encodes the input speech signal to a voice code of the encoding scheme 1 and outputs this code to a transmission path 71*b*. When the voice code enters via the transmission path 71*b*, a decoder 73*a* of the voice code converter 73 decodes reproduced voice from the voice code of encoding scheme 1. An encoder 73*b* of the voice code converter 73 then converts the reconstructed speech signal to voice code of the encoding scheme 2 and sends this voice code to a transmission path 72*b*. The voice code of the encoding scheme 2 is input to the terminal 72 through the transmission path 72*b*. Upon receiving the voice code as an input, the decoder 72*a* decodes reconstructed speech from the voice code of the encoding scheme 2. As a result, the user B on the receiving side is capable of hearing the reconstructed speech. Processing for decoding voice that has first been encoded and then re-encoding the decoded voice is referred to as "tandem connection".

With the implementation of prior art 1, as described above, the practice is to rely upon the tandem connection in which a voice code that has been encoded by voice encoding scheme 1 is decoded into voice temporarily, after which the decoded voice is re-encoded by voice encoding scheme 2. Problems arise as a consequence, namely a pronounced decline in the quality of reconstructed speech and an increase in delay. In other words, voice (reconstructed speech) that has been encoded and compressed in terms of information content is voice having less information than that of the original voice (original sound). Hence the sound quality of the reconstructed speech is much poorer than that of the original sound. In particular, with recent low-bit-rate voice encoding schemes typified by G.729A and EVRC, encoding is performed while discarding a great deal of information contained in the input voice in order to realize a high compression rate. When use is made of a tandem connection in which encoding and decoding are repeated, the quality of reconstructed speed undergoes a market decline.

A technique proposed as a method of solving this problem of the tandem connection decomposes voice code into parameter codes such as LSP code and pitch-lag code without returning the voice code to a speech signal, and converts each parameter code separately to a code of a separate voice encoding scheme (see the specification of Japanese Patent Application No. 2001-75427). FIG. 24 is a diagram illustrating the principle of this proposal, which shall be referred to as "prior art 2" below.

Encoder 71*a* of encoding scheme 1 incorporated in terminal 1 encodes a speech signal produced by user A to a voice code of encoding scheme 1 and sends this voice code to transmission path 71*b*. A voice code conversion unit 74 converts the voice code of encoding scheme 1 that has entered from the transmission path 71*b* to a voice code of encoding scheme 2 and sends this voice code to transmission path 72*b*. Decoder 72*a* in terminal 72 decodes reconstructed speech from the voice code of encoding scheme 2 that enters via the transmission path 72*b*, and user B is capable of hearing the reconstructed speech.

The encoding scheme 1 encodes a speech signal by ① a first LSP code obtained by quantizing LSP parameters, which are found from linear prediction coefficients (LPC) obtained by frame-by-frame linear prediction analysis; ② a first pitch-lag code, which specifies the output signal of an adaptive codebook that is for outputting a periodic sound-source signal; ③ a first algebraic code (noise code), which specifies the output signal of an algebraic codebook (or noise codebook) that is for outputting a noise-like sound-source signal; and ④ a first gain code obtained by quantizing pitch gain, which represents the amplitude of the output signal of the adaptive codebook, and algebraic codebook gain, which represents the amplitude of the output signal of the algebraic codebook. The encoding scheme 2 encodes a speech signal by ① a second LPC code, ② a second pitch-lag code, ③ a second algebraic code (noise code) and ④ a second gain code, which are obtained by quantization in accordance with a quantization method different from that of voice encoding scheme 1.

The voice code conversion unit 74 has a code demultiplexer 74*a*, an LSP code converter 74*b*, a pitch-lag code converter 74*c*, an algebraic code converter 74*d*, a gain code converter 74*e* and a code multiplexer 74*f*. The code demultiplexer 74*a* demultiplexes the voice code of voice encoding scheme 1, which code enters from the encoder 71*a* of terminal 71 via the transmission path 71*b*, into codes of a plurality of components necessary to reconstruct a speech signal, namely ① LSP code, ② pitch-lag code, ③ algebraic code and ④ gain code. These codes are input to the code converters 74*b*, 74*c*, 74*d* and 74*e*, respectively. The latter convert the entered LSP code, pitch-lag code, algebraic code and gain code of voice encoding scheme 1 to LSP code, pitch-lag code, algebraic code and gain code of voice encoding scheme 2, and the code multiplexer 74*f* multiplexes these codes of voice encoding scheme 2 and sends the multiplexed signal to the transmission path 72*b*.

FIG. 25 is a block diagram illustrating the voice code conversion unit 74 in which the construction of the code converters 74*b* to 74*e* is clarified. Components in FIG. 25 identical with those shown in FIG. 24 are designated by like reference characters. The code demultiplexer 74*a* demultiplexes an LSP code 1, a pitch-lag code 1, an algebraic code 1 and a gain code 1 from the speech signal of encoding scheme 1 that enters from the transmission path via an input terminal #1, and inputs these codes to the code converters 74*b*, 74*c*, 74*d* and 74*e*, respectively.

The LSP code converter 74*b* has an LSP dequantizer $\mathbf{74}b_1$ for dequantizing the LSP code 1 of encoding scheme 1 and outputting an LSP dequantized value, and an LSP quantizer $\mathbf{74}b_2$ for quantizing the LSP dequantized value using an algebraic code quantization table of encoding scheme 2 and outputting an LSP code 2. The pitch-lag code converter 74*c* has a pitch-lag dequantizer $\mathbf{74}c_1$ for dequantizing the pitch-lag code 1 of encoding scheme 1 and outputting a pitch-lag dequantized value, and a pitch-lag quantizer $\mathbf{74}c_2$ for quantizing the pitch-lag dequantized value by encoding scheme 2 and outputting a pitch-lag code 2. The algebraic code converter 74*d* has an algebraic dequantizer $\mathbf{74}d_1$ for dequantizing the algebraic code 1 of encoding scheme 1 and outputting an algebraic dequantized value, and an algebraic quantizer $\mathbf{74}d_2$ for quantizing the algebraic dequantized value using an algebraic code quantization table of encoding scheme 2 and outputting an algebraic code 2. The gain code converter 74*e* has a gain dequantizer $\mathbf{74}e_1$ for dequantizing the gain code 1 of encoding scheme 1 and outputting a gain dequantized value, and a gain quantizer $\mathbf{74}e_2$ for quantizing the gain dequantized value using a gain quantization table of encoding scheme 2 and outputting a gain code 2.

The code multiplexer 74*f* multiplexes the LSP code 2, pitch-lag code 2, algebraic code 2 and gain code 2, which are output from the quantizers $\mathbf{74}b_2$, $\mathbf{74}c_2$, $\mathbf{74}d_2$ and $\mathbf{74}e_2$, respectively, thereby creating a voice code based upon encoding scheme 2, and sends this code to the transmission path from an output terminal #2.

The tandem connection scheme (prior art 1) of FIG. 23 receives an input of reproduced speech, which is obtained by temporarily decoding, to voice, voice code that has been encoded by encoding scheme 1, and executes encoding and decoding again. As a result, voice parameters are extracted from reproduced speech in which the amount of information is much less than that of the original sound owing to re-execution of encoding (namely compression of voice information). Consequently, the voice code thus obtained is not necessarily the best. By contrast, in accordance with the voice encoding apparatus of prior art 2 shown in FIG. 24, voice code of encoding scheme 1 is converted to voice code of encoding scheme 2 via the process of dequantization and quantization. This makes it possible to perform voice code conversion in which there is much less degradation in comparison with the tandem connection of prior art 1. Further, since it is unnecessary to decode to voice even once for the sake of voice code conversion, another advantage is that delay, which is a problem with the tandem connection, is reduced.

In a VoIP network, G.729A is used as the voice encoding scheme. In a cdma 2000 network, on the other hand, which is expected to served as a next-generation cellular telephone system, EVRC is adopted. Table 6 below indicates results obtained by comparing the main specifications of G.729A and EVRC.

TABLE 6

COMPARISON OF G.729A AND EVRC MAIN SPECIFICATIONS

| | G.729A | EVRC |
|---|---|---|
| SAMPLING FREQUENCY | 8 kHz | 8 kHz |
| FRAME LENGTH | 10 ms | 20 ms |
| SUBFRAME LENGTH | 5 ms | 6.625/6.625/6.75 ms |
| NUMBER OF SUBFRAMES | 2 | 3 |

Frame length and subframe length according to G.729A are 10 ms and 5 ms, respectively, while EVRC frame length is 20 ms and is segmented into three subframes. This means that EVRC subframe length is 6.625 ms (only the final subframe has a length of 6.75 ms), and that both frame length and subframe length differ from those of G.729A. Table 7 below indicates the results obtained by comparing bit allocation of G.729A with that of EVRC.

TABLE 7

G.729A AND EVRC BIT ALLOCATION

| PARAMETER | G.729A SUBFRAME/FRAME | EVRC (FULL RATE) SUBFRAME/FRAME |
|---|---|---|
| LSP CODE | —/18 | —/29 |
| PITCH-LAG CODE | 8, 5/13 | —/12 |
| PITCH-GAIN CODE | — | 3, 3, 3/9 |
| ALGEBRAIC CODE | 17, 17/34 | 35, 35, 35/105 |
| ALGEBRAIC CODE GAIN CODE | — | 5, 5, 5/15 |
| GAIN CODE | 7, 7/14 | — |
| NOT ASSIGNED | — | —/1 |
| TOTAL | 80 BITS/10 ms | 171 BITS/20 ms |

In a case where voice communication is performed between a VoIP network and a network compliant with cdma 2000, a voice code conversion technique for converting one voice code to another voice code is required. The above-described examples of prior art 1 and prior art 2 are known as techniques used in such case.

With prior art 1, speech is reconstructed temporarily from voice code according to voice encoding scheme 1, and the reconstructed speech is applied as an input and encoded again according to voice encoding scheme 2. This makes it possible to convert code without being affected by the difference between the two encoding schemes. However, when the re-encoding is performed according to this method, certain problems arise, namely pre-reading (i.e., delay) of signals owing to LPC analysis and pitch analysis, and a major decline in sound quality.

With voice code conversion according to prior art 2, a conversion to voice code is made on the assumption that subframe length in encoding scheme 1 and subframe length in encoding scheme 2 are equal, and therefore a problem arises in code conversion in a case where the subframe lengths of the two encoding schemes differ. That is, since the algebraic codebook is such that pulse position candidates are decided in accordance with subframe length, pulse positions are completely different between schemes (G.729A and EVRC) having different subframe lengths, and it is difficult to make pulse positions correspond on a one-to-one basis.

SUMMARY OF THE INVENTION

Accordingly, an object of the present invention is to make it possible to perform a voice code conversion even between voice encoding schemes having different subframe lengths.

Another object of the present invention is to make it possible to reduce a decline in sound quality and, moreover, to shorten delay time.

According to a first aspect of the present invention, the foregoing objects are attained by providing a voice code conversion system for converting a voice code obtained by encoding performed by a first voice encoding scheme to a voice code of a second voice encoding scheme. The voice code conversion system includes a code demultiplexer for demultiplexing, from the voice code based on the first voice encoding scheme, a plurality of code components necessary to reconstruct a voice signal; and a code converter for dequantizing the codes of each of the components, outputting dequantized values and converting the dequantized values of code components other than an algebraic code to code components of a voice code of the second voice encoding scheme. Further, a voice reproducing unit reproduces voice using each of the dequantized value, a target generating unit dequantizes each code component of the second voice encoding scheme and generates a target signal using each dequantized value and reproduced voice, and an algebraic code converter obtains an algebraic code of the second voice encoding scheme using the target signal. In addition, a code multiplexer multiplexes and outputs code components in the second voice encoding scheme.

More specifically, the first aspect of the present invention is a voice code conversion system for converting a first voice code, which has been obtained by encoding a voice signal by an LSP code, pitch-lag code, algebraic code and gain code based upon a first voice encoding scheme, to a second voice code based upon a second voice encoding scheme. According to this voice code conversion system, LSP code, pitch-lag code and gain code of the first voice code are dequantized and the dequantized values are quantized by the second voice encoding scheme to acquire LSP code, pitch-lag code and gain code of the second voice code. Next, a pitch-periodicity synthesis signal is generated using the dequantized values of the LSP code, pitch-lag code and gain code of the second voice encoding scheme, a voice signal is reproduced from the first voice code, and a difference signal between the reproduced voice signal and pitch-periodicity synthesis signal is generated as a target signal. Thereafter, an algebraic synthesis signal is generated using any algebraic code in the second voice encoding scheme and a dequantized value of LSP code of the second voice code, and an algebraic code in the second voice encoding scheme that minimizes the difference between the target signal and the algebraic synthesis signal is acquired. The acquired LSP code, pitch-lag code, algebraic code and gain code in the second voice encoding scheme are multiplexed and output.

If this arrangement is adopted, it is possible to perform a voice code conversion even between voice encoding schemes having different subframe lengths. Moreover, a decline in sound quality can be reduced and delay time shortened. More specifically, voice code according to the G.729A encoding scheme can be converted to voice code according to the EVRC encoding scheme.

According to a second aspect of the present invention, the foregoing objects are attained by providing a voice code conversion system for converting a first voice code, which has been obtained by encoding a speech signal by LSP code, pitch-lag code, algebraic code, pitch-gain code and algebraic codebook gain code based upon a first voice encoding scheme, to a second voice code based upon a second voice encoding scheme. According to this voice code conversion system, each code constituting the first voice code is dequantized and dequantized values of LSP code and pitch-lag code and gain code of the first voice code are quantized by the second voice encoding scheme to acquire LSP code and pitch-lag code of the second voice code. Further, a dequantized value of pitch-gain code of the second voice code is calculated by interpolation processing using a dequantized value of pitch-gain code of the first voice code. Next, a pitch-periodicity synthesis signal is generated using the dequantized values of the LSP code, pitch-lag code and pitch gain of the second voice code, a voice signal is reproduced from the first voice code, and a difference signal between the reproduced voice signal and pitch-periodicity synthesis signal is generated as a target signal. Thereafter, an algebraic synthesis signal is generated using any algebraic code in the second voice encoding scheme and a dequantized value of LSP code of the second voice code, and an algebraic code in the second voice encoding scheme that will minimize the difference between the target signal and the algebraic synthesis signal is acquired. Next, gain code of the second voice code obtained by combining the pitch gain and algebraic codebook gain is acquired by the second voice encoding scheme using the dequantized value of the LSP code of the second voice code, the pitch-lag code and algebraic code of the second voice code, and the target signal. The acquired LSP code, pitch-lag code, algebraic code and gain code in the second voice encoding scheme are output.

If the arrangement described above is adopted, it is possible to perform a voice code conversion even between voice encoding schemes having different subframe lengths. Moreover, a decline in sound quality can be reduced and delay time shortened. More specifically, voice code according to the EVRC encoding scheme can be converted to voice code according to the G.729A encoding scheme.

Other features and advantages of the present invention will be apparent from the following description taken in conjunction with the accompanying drawings.

BRIEF DESCRIPTION OF THE DRAWINGS

FIG. 18 is a diagram useful in describing an algebraic codebook according to G.729A in the prior art;

DESCRIPTION OF THE PREFERRED EMBODIMENTS

(A) Overview of the Present Invention

Figure 1:
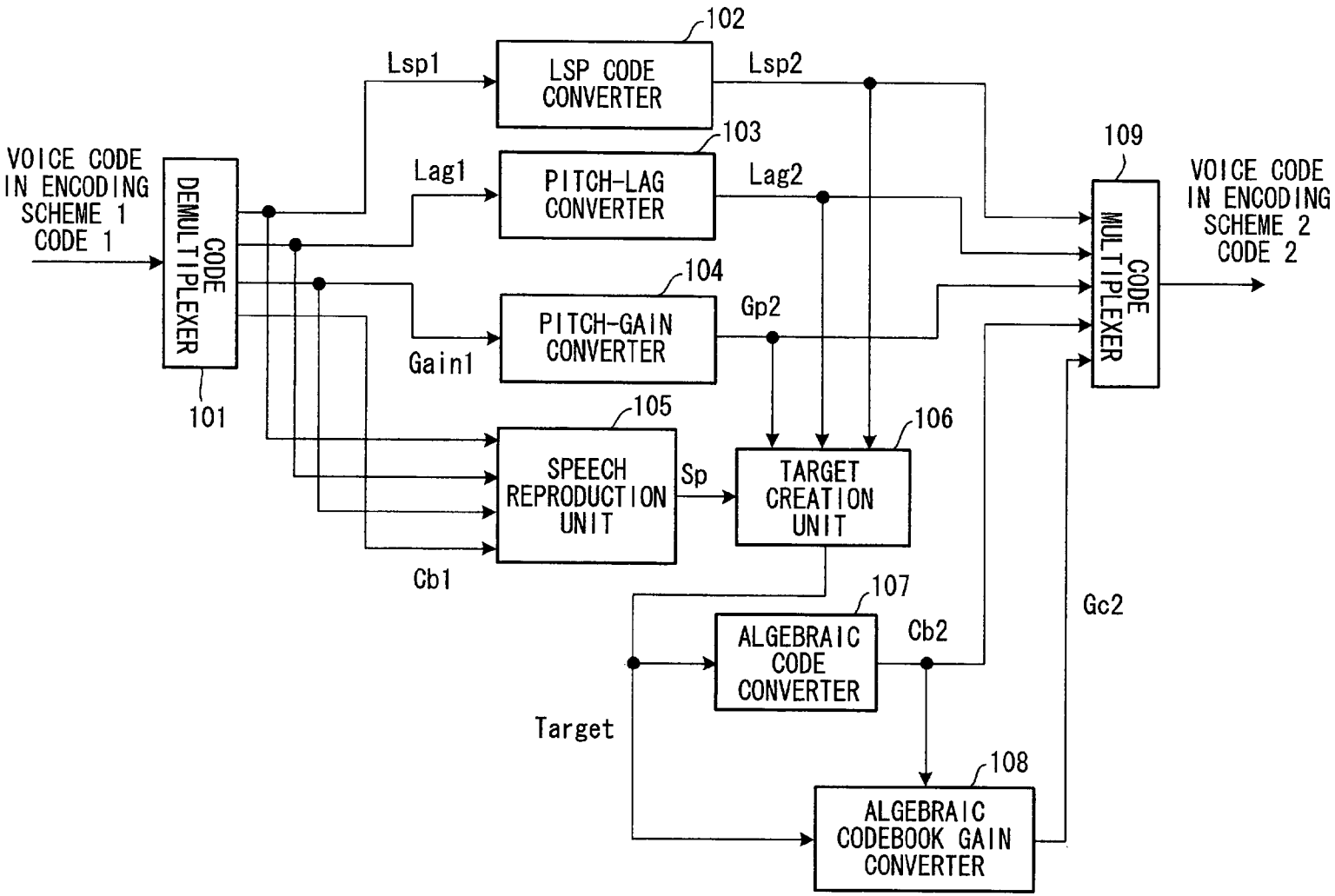
FIG. 1 is a block diagram useful in describing the principles of the present invention.

FIG. 1 is a block diagram useful in describing the principles of a voice code conversion apparatus according to the present invention. FIG. 1 illustrates an implementation of the principles of a voice code conversion apparatus in a case where a voice code CODE1 according to an encoding scheme 1 (G.729A) is converted to a voice code CODE2 according to an encoding scheme 2 (EVRC).

The present invention converts LSP code, pitch-lag code and pitch-gain code from encoding scheme 1 to encoding scheme 2 in a quantization parameter region through a method similar to that of prior art 2, creates a target signal from reproduced voice and a pitch-periodicity synthesis signal, and obtains an algebraic code and algebraic codebook gain in such a manner that error between the target signal and algebraic synthesis signal is minimized. Thus the invention is characterized in that a conversion is made from encoding scheme 1 to encoding scheme 2. The details of the conversion procedure will now be described.

When voice code CODE1 according to encoding scheme 1 (G.729A) is input to a code demultiplexer 101, the latter demultiplexes the voice code CODE1 into the parameter codes of an LSP code Lsp1, pitch-lag code Lag1, pitch-gain code Gain1 and algebraic code Cb1, and inputs these parameter codes to an LSP code converter 102, pitch-lag converter 103, pitch-gain converter 104 and speech reproduction unit 105, respectively.

The LSP code converter 102 converts the LSP code Lsp1 to LSP code Lsp2 of encoding scheme 2, the pitch-lag converter 103 converts the pitch-lag code Lag1 to pitch-lag code Lag2 of encoding scheme 2, and the pitch-gain converter 104 obtains a pitch-gain dequantized value from the pitch-gain code Gain1 and converts the pitch-gain dequantized value to a pitch-gain code Gp2 of encoding scheme 2.

The speech reproduction unit 105 reproduces a speech signal Sp using the LSP code Lsp1, pitch-lag code Lag1, pitch-gain code Gain1 and algebraic code Cb1, which are the code components of the voice code CODE1. A target creation unit 106 creates a pitch-periodicity synthesis signal of encoding scheme 2 from the LSP code Lsp2, pitch-lag code Lag2 and pitch-gain code Gp2 of voice encoding scheme 2. The target creation unit 106 then subtracts the pitch-periodicity synthesis signal from the speech signal Sp to create a target signal Target.

An algebraic code converter 107 generates an algebraic synthesis signal using any algebraic code in the voice encoding scheme 2 and a dequantized value of the LSP code Lsp2 of voice encoding scheme 2 and decides an algebraic code Cb2 of voice encoding scheme 2 that will minimize the difference between the target signal Target and this algebraic synthesis signal.

An algebraic codebook gain converter 108 inputs an algebraic codebook output signal that conforms to the algebraic code Cb2 of voice encoding scheme 2 to an LPC synthesis filter constituted by the dequantized value of the LSP code Lsp2, thereby creating an algebraic synthesis signal, decides algebraic codebook gain from this algebraic synthesis signal and the target signal, and generates algebraic codebook gain code Gc2 using a quantization table compliant with encoding scheme 2.

A code multiplexer 109 multiplexes the LSP code Lsp2, pitch-lag code Lag2, pitch-gain code Gp2, algebraic code Cb2 and algebraic codebook gain code Gc2 of encoding scheme 2 obtained as set forth above, and outputs these codes as voice code CODE2 of encoding scheme 2.

(B) First Embodiment

Figure 2:
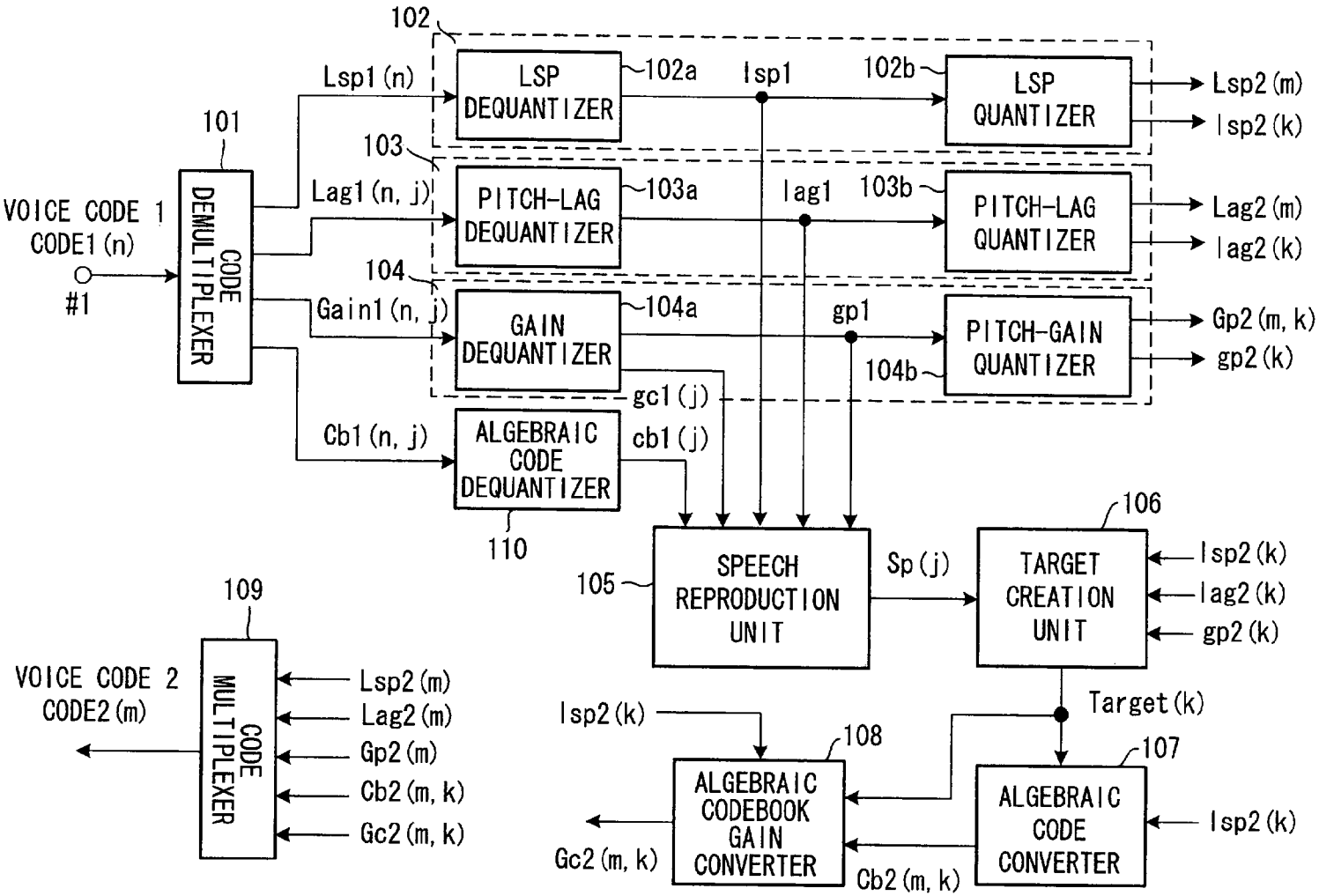
FIG. 2 is a block diagram of the structure of a voice code conversion apparatus according to a first embodiment of the present invention.

FIG. 2 is a block diagram of a voice code conversion apparatus according to a first embodiment of the present invention. Components in FIG. 2 identical with those shown in FIG. 1 are designated by like reference characters. This embodiment illustrates a case where G.729A is used as voice encoding scheme 1 and EVRC as voice encoding scheme 2. Further, though three modes, namely full-rate, half-rate and ⅛-rate modes are available in EVRC, here it will be assumed that only the full-rate mode is used.

Figure 3:
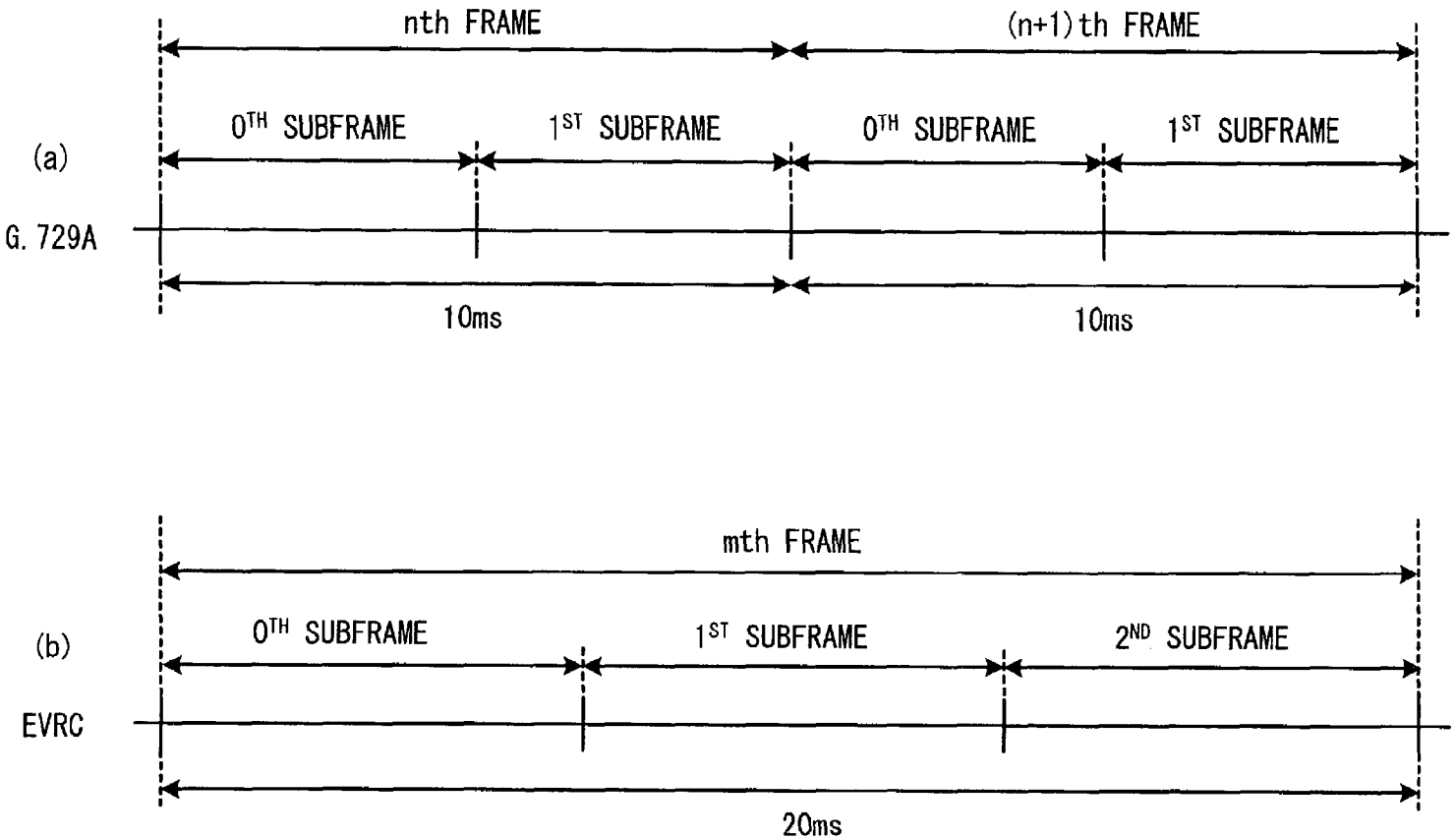
FIG. 3 is a diagram showing the structures of G.729A and EVRC frames.

Since frame length is 10 ms in G.729A and 20 ms in EVRC, two frames of voice code in G.729A is converted one frame of voice code in EVRC. A case will now be described in which voice code of an nth frame and (n+1)th frame of G.729A shown in (a) of FIG. 3 is converted to voice code of an mth frame in EVRC shown in (b) of FIG. 3.

In FIG. 2, an nth frame of voice code (channel data) CODE1(n) is input from a G.729A-compliant encoder (not shown) to a terminal #1 via a transmission path. The code demultiplexer 101 demultiplexes LSP code Lsp1(n), pitch-lag code Lag1(n,j), gain code Gain1(n,j) and algebraic code Cb1(n,j) from the voice code CODE1(n) and inputs these codes to the converters 102, 103, 104 and an algebraic code dequantizer 110, respectively. The index "j" within the parentheses represents the number of a subframe [see (a) in FIG. 3] and takes on a value of 0 or 1.

The LSP code converter 102 has an LSP dequantizer 102*a* and an LSP quantizer 102*b*. As mentioned above, the G.729A frame length is 10 ms, and a G.729A encoder quantizes an LSP parameter, which has been obtained from an input signal of the first subframe, only once in 10 ms. By contrast, EVRC frame length is 20 ms, and an EVRC encoder quantizes an LSP parameter, which has been obtained from an input signal of the second subframe and pre-read segment, once every 20 ms. In other words, if the same 20 ms is considered as the unit time, the G.729A encoder performs LSP quantization twice whereas the EVRC encoder performs quantization only once. As a consequence, two consecutive frames of LSP code in G.729A cannot be converted to EVRC-compliant LSP code as is.

Accordingly, in the first embodiment, the arrangement is such that only LSP code in a G.729A-compliant odd-numbered frame [(n+1)th frame] is converted to EVRC-compliant LSP code; LSP code in a G.729A-compliant even-numbered frame (nth frame) is not converted. However, it can also be so arranged that LSP code in a G.729A-compliant even-numbered frame is converted to EVRC-compliant LSP code, while LSP code in a G.729A-compliant odd-numbered frame is not converted.

When the LSP code Lsp1(n) is input to the LSP dequantizer 102*a*, the latter dequantizes this code and outputs an LSP dequantized value lsp1, where lsp1 is a vector comprising ten coefficients. Further, the LSP dequantizer 102*a* performs an operation similar to that of the dequantizer used in a G.729A-compliant decoder.

When the LSP dequantized value lsp1 of an odd-numbered frame enters the LSP quantizer 102*b*, the latter performs quantization in accordance with the EVRC-compliant LSP quantization method and outputs an LSP code Lsp2(m). Though the LSP quantizer 102*b* need not necessarily be exactly the same as the quantizer used in the EVRC encoder, at least its LSP quantization table is the same as the EVRC quantization table. It should be noted that an LSP dequantized value of an even-numbered frame is not used in LSP code conversion. Further, the LSP dequantized value lsp1 is used as a coefficient of an LPC synthesis filter in the speech reproduction unit 105, described later.

Next, using linear interpolation, the LSP quantizer 102*b* obtains LSP parameters lsp2(k) (k=0, 1, 2) in three subframes of the present frame from an LSP dequantized value, which is obtained by decoding the LSP code Lsp2(m) resulting from the conversion, and an LSP dequantized value obtained by decoding an LSP code Lsp2(m−1) of the preceding frame. Here lsp2(k) is used by the target creation unit 106, etc., described later, and is a 10-dimensional vector.

The pitch-lag converter 103 has a pitch-lag dequantizer 103*a* and a pitch-lag quantizer 103*b*. According to the G.729A scheme, pitch lag is quantized every 5-ms subframe. With EVRC, on the other hand, pitch lag is quantized once in one frame. If 20 ms is considered as the unit time, G.729A quantizes four pitch lags, while EVRC quantizes only one. Accordingly, in a case where G.729A voice code is converted to EVRC voice code, all pitch lags in G.729A cannot be converted to EVRC pitch lag.

Accordingly, in the first embodiment, pitch lag lag1 is found by quantizing pitch-lag code Lag1(n+1, 1) in the final subframe (first subframe) of a G.729A (n+1)th frame by the G.729A pitch-lag dequantizer 103*a*, and the pitch lag lag1 is quantized by the pitch-lag quantizer 103*b* to obtain the pitch-lag code Lag2(m) in the second subframe of the mth frame. Further, the pitch-lag quantizer 103*b* interpolates pitch lag by a method similar to that of the encoder and decoder of the EVRC scheme. That is, the pitch-lag quantizer 103*b* finds pitch-lag interpolated values lag2(k) (k=0, 1, 2) of each of the subframes by linear interpolation between a pitch-lag dequantized value of the second subframe obtained by dequantizing Lag2(m) and a pitch-lag dequantized value of the second subframe of the preceding frame. These pitch-lag interpolated values are used by the target creation unit 106, described later.

Figure 4:
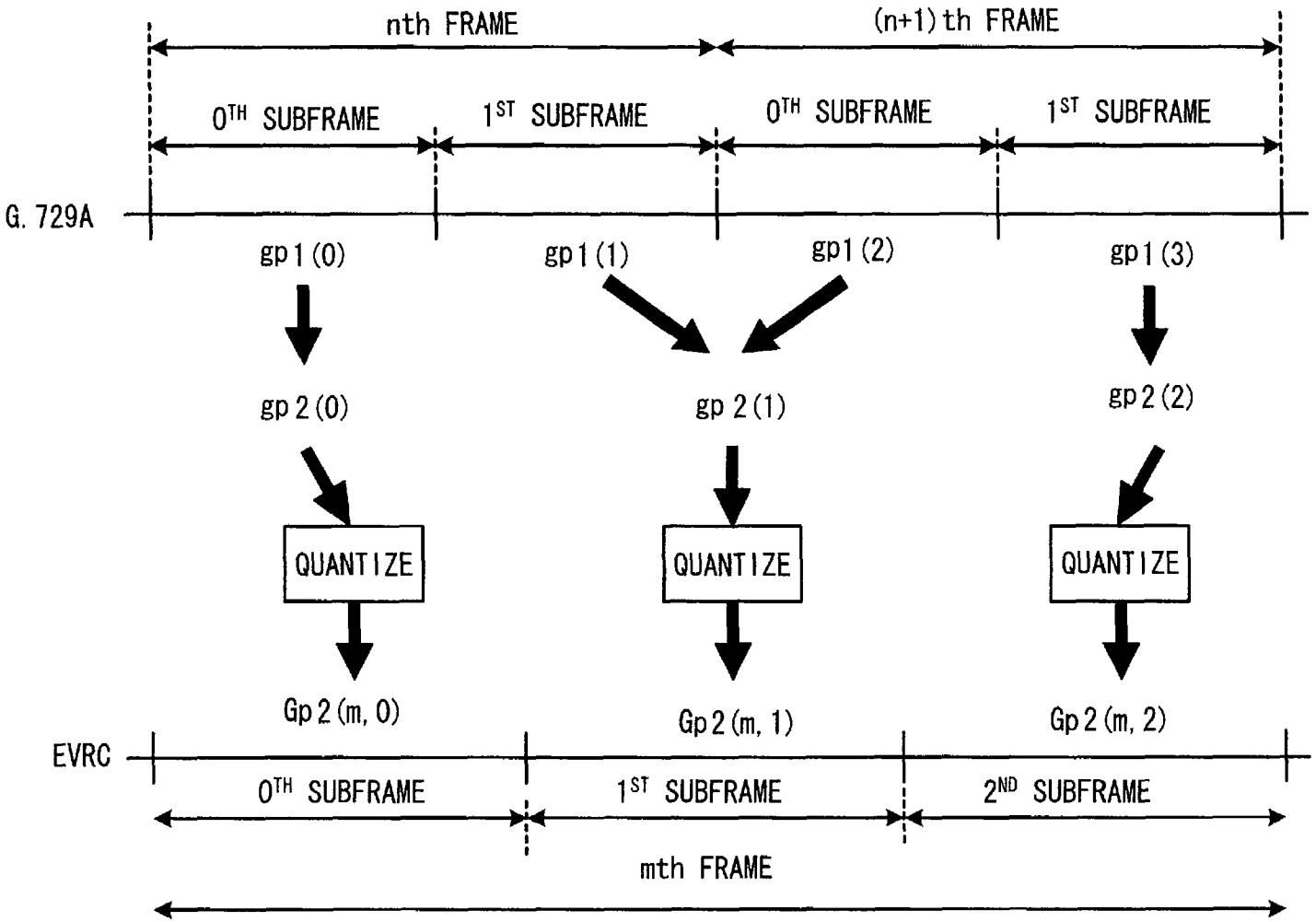
FIG. 4 is a diagram useful in describing conversion of a pitch-gain code.

The pitch-gain converter 104 has a pitch-gain dequantizer 104*a* and a pitch-gain quantizer 104*b*. According to G.729A, pitch gain is quantized every 5-ms subframe. If 20 ms is considered to be the unit time, therefore, G.729A quantizes four pitch gains in one frame, while EVRC quantizes three pitch gains in one frame. Accordingly, in a case where G.729A voice code is converted to EVRC voice code, all pitch gains in G.729A cannot be converted to EVRC pitch gains. Hence, in the first embodiment, gain conversion is carried out by the method shown in FIG. 4. Specifically, pitch gain is synthesized in accordance with the following equations:

$$gp2(0)=gp1(0)$$

$$gp2(1)=[gp1(1)+gp(2)]/2$$

$$gp2(2)=gp1(3)$$

where gp1(0), gp1(1), gp1(2), gp1(3) represent the pitch gains of two consecutive frames in G.729A. The synthesized pitch gains gp2(k) (k=0, 1, 2) are scalar quantized using an EVRC pitch-gain quantization table, whereby pitch-gain code Gp2(m,k) is obtained. The pitch gains gp2(k) (k=0, 1, 2) are used by the target creation unit 106, described later.

The algebraic code dequantizer 110 dequantizes an algebraic code Cb(n,j) and inputs an algebraic code dequantized value cb1(j) obtained to the speech reproduction unit 105.

Figure 5:
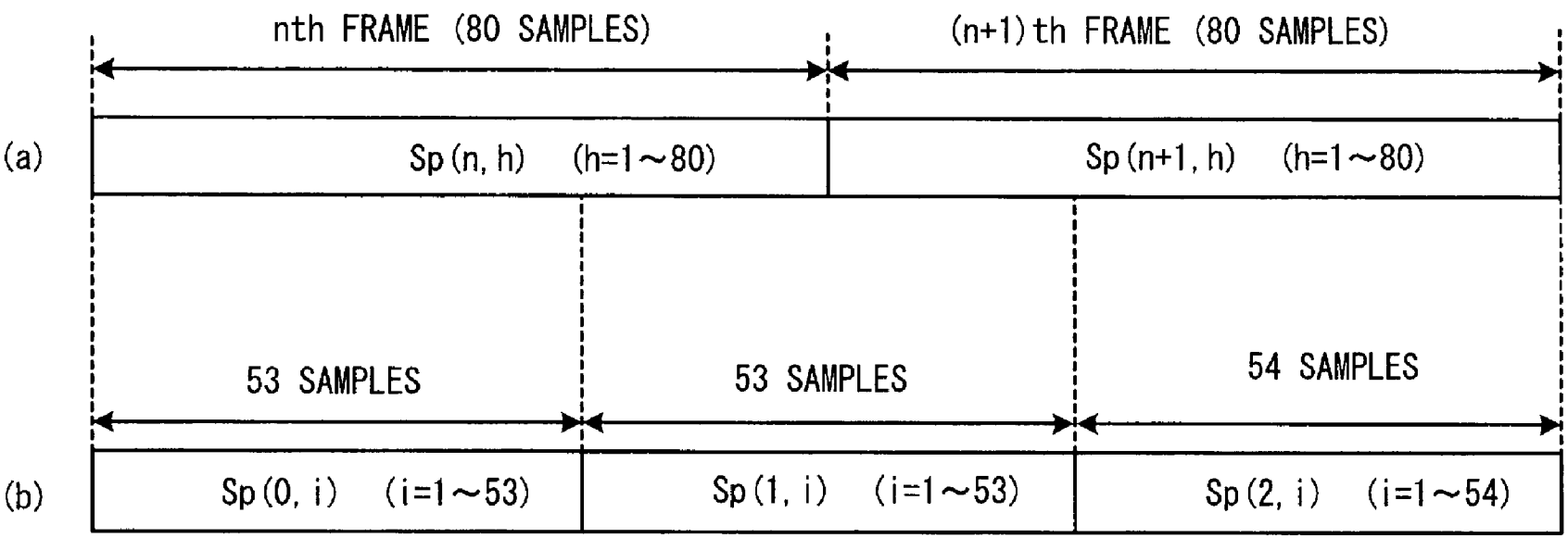
FIG. 5 is a diagram useful in describing numbers of samples of subframes according to G.729A and EVRC.

The speech reproduction unit 105 creates G.729A-compliant reproduced speech Sp(n,h) in an nth frame and G.729A-compliant reproduced speech Sp(n+1,h) in an (n+1)th frame. The method of creating reproduced speech is the same as the operation performed by a G.729A decoder and has already been described in the section pertaining to the prior art; no further description is given here. The number of dimensions of the reproduced speech Sp(n,h) and Sp(n+1,h) is 80 samples (h=1 to 80), which is the same as the G.729A frame length, and there are 160 samples in all. This is the number of samples per frame according to EVRC. The speech reproduction unit 105 partitions the reproduced speech Sp(n,h) and Sp(n+1,h) thus created into three vectors Sp(0,i), Sp(1,i), Sp(2,i), as shown in FIG. 5, and outputs the vectors. Here i is 1 to 53 in $0^{th}$ and $1^{st}$ subframes and 1 to 54 in the $2^{nd}$ subframe.

Figure 6:
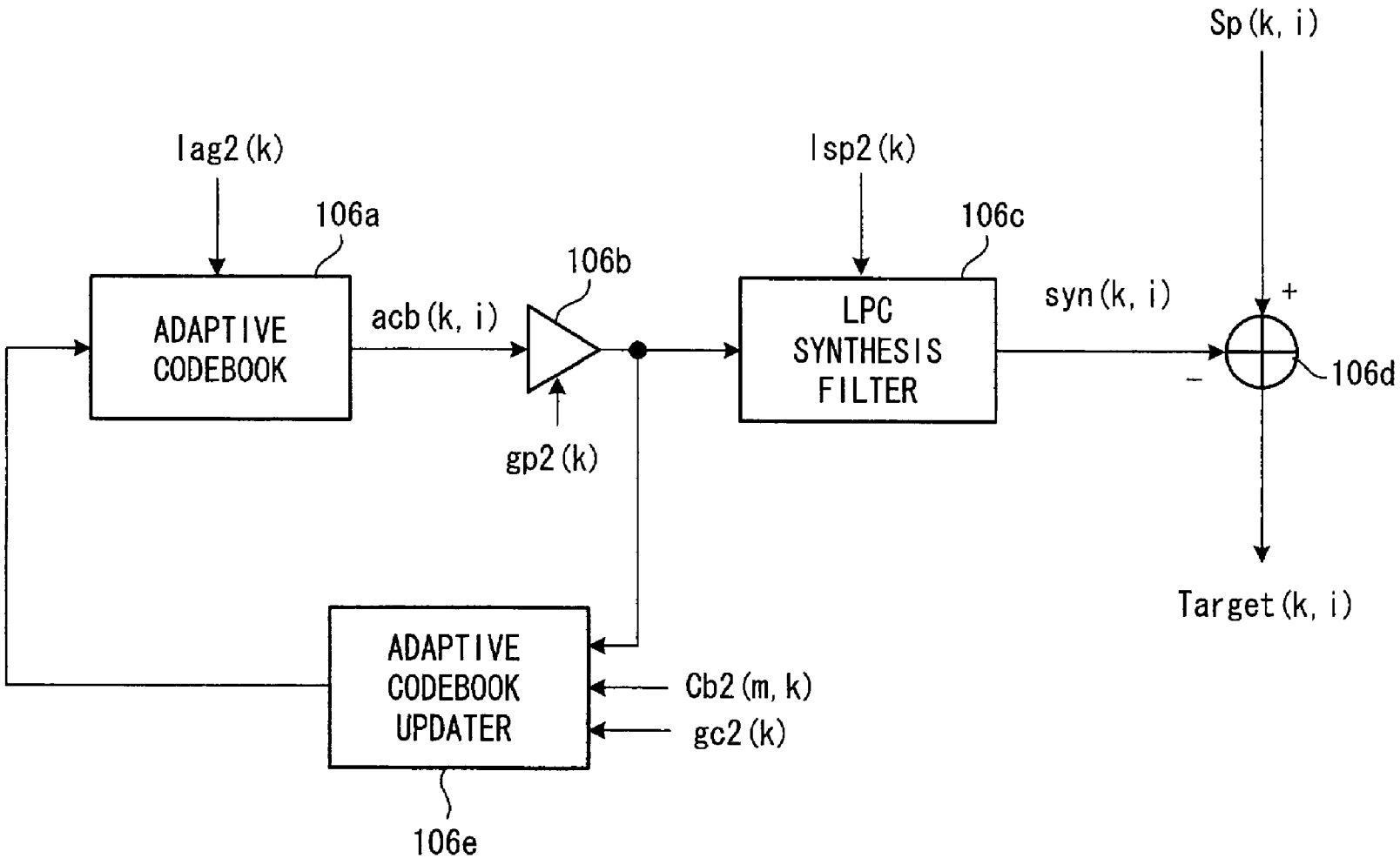
FIG. 6 is a block diagram showing the structure of a target generator.

The target creation unit 106 creates a target signal Target (k,i) used as a reference signal in the algebraic code converter 107 and algebraic codebook gain converter 108. FIG. 6 is a block diagram of the target creation unit 106. An adaptive codebook 106*a* outputs N sample signals acb(k,i) (i=0 to N−1) corresponding to the pitch lag lag2(k) obtained by the pitch-lag converter 103. Here k represents the EVRC subframe number, and N stands for the EVRC subframe length, which is 53 in $0^{th}$ and $1^{st}$ subframes and 54 in the $2^{nd}$ subframe. Unless stated otherwise, the index i is 53 or 54. Numeral 106*e* denotes an adaptive codebook updater.

A gain multiplier 106*b* multiplies the adaptive codebook output acb(k,i) by pitch gain gp2(k) and inputs the product to an LPC synthesis filter 106*c*. The latter is constituted by the dequantized value lsp2(k) of the LSP code and outputs an adaptive codebook synthesis signal syn(k,i). A multiplier 106*d* obtains a target signal Target(k,i) by subtracting the adaptive codebook synthesis signal syn(k,i) from the speech signal Sp(k,i), which has been partitioned into three parts. The signal Target(k,i) is used in the algebraic code converter 107 and algebraic codebook gain converter 108, described below.

Figure 7:
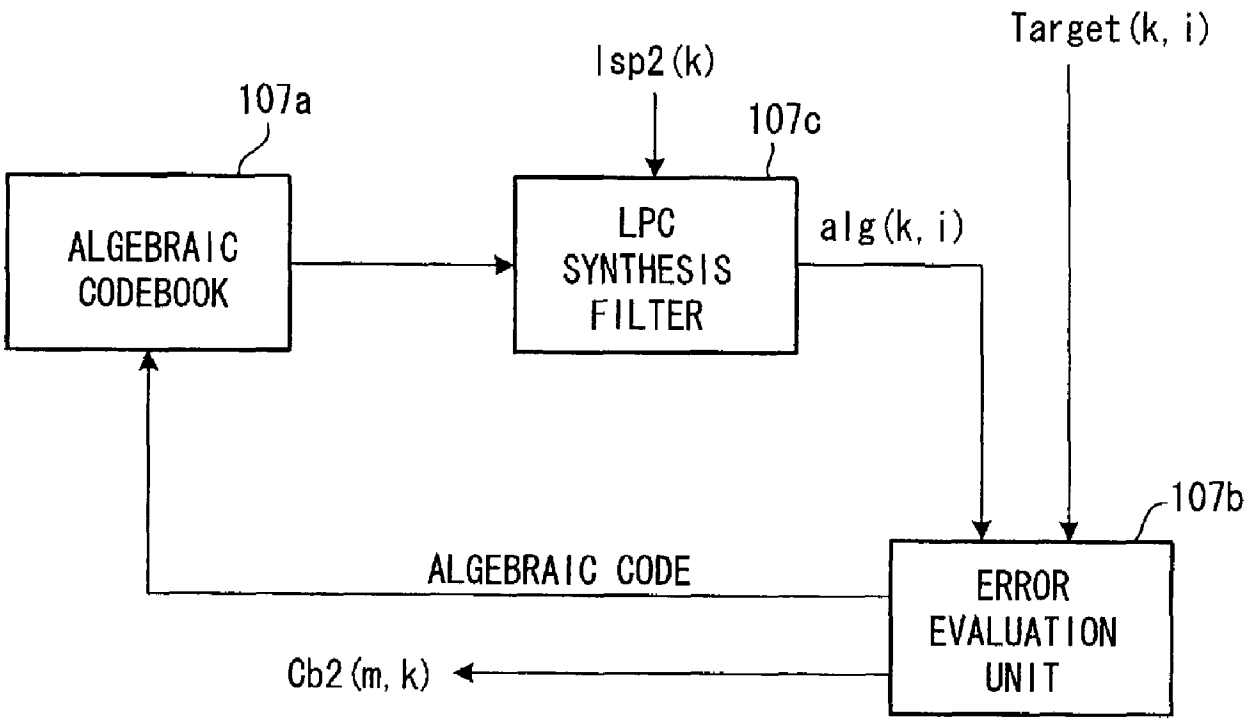
FIG. 7 is a block diagram showing the structure of an algebraic code converter.

The algebraic code converter 107 executes processing exactly the same as that of an algebraic code search in EVRC. FIG. 7 is a block diagram of the algebraic code converter 107. An algebraic codebook 107*a* outputs any pulsed sound-source signal that can be produced by a combination of pulse positions and polarity shown in Table 3. Specifically, if output of a pulsed sound-source signal conforming to a prescribed algebraic code is specified by an error evaluation unit 107*b*, the algebraic codebook 107*a* inputs a pulsed sound-source signal conforming to the specified algebraic code to an LPC synthesis filter 107*c*. When the algebraic codebook output signal is input to the LPC synthesis filter 107*c*, the latter, which is constituted by the dequantized value lsp2(k) of the LSP code, creates and outputs an algebraic synthesis signal alg(k,i). The error evaluation unit 107*b* calculates a cross-correlation value Rcx between the algebraic synthesis signal alg(k,i) and target signal Target(k,i) as well as an autocorrelation value Rcc of the algebraic synthesis signal, searches for an algebraic code Cb2(m,k) that will afford the largest normalized cross-correlation value (Rcx·Rcx/Rcc) obtained by normalizing the square of Rcx by Rcc, and outputs this algebraic code.

Figure 8:
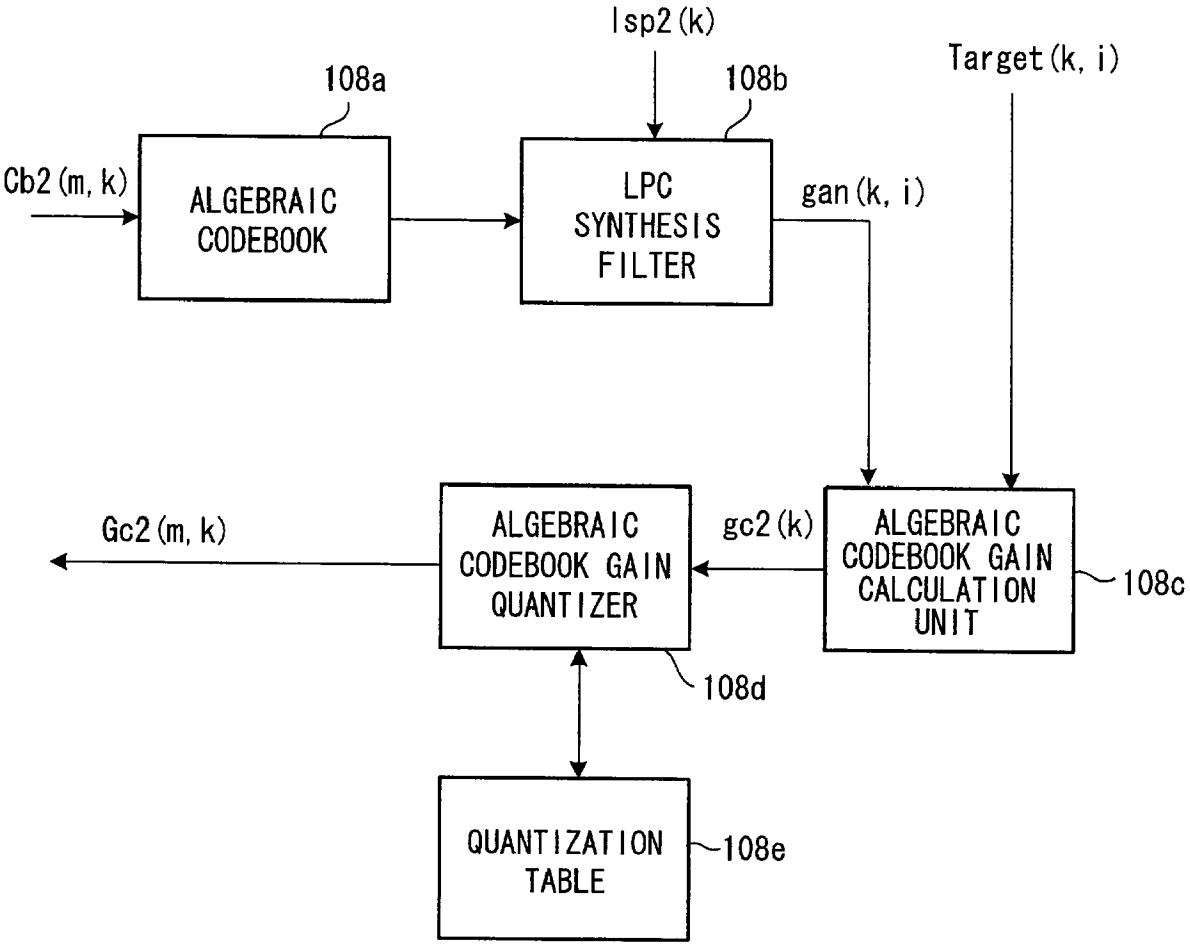
FIG. 8 is a block diagram showing the structure of an algebraic codebook gain converter.

The algebraic codebook gain converter 108 has the structure shown in FIG. 8. An algebraic codebook 108*a* generates a pulsed sound-source signal that corresponds to the algebraic code Cb2(m,k) obtained by the algebraic code converter 107, and inputs this signal to an LPC synthesis filter 108*b*. When the algebraic codebook output signal is input to the LPC synthesis filter 108*b*, the latter, which is constituted by the dequantized value lsp2(k) of the LSP code, creates and outputs an algebraic synthesis signal gan(k,i). An algebraic codebook gain calculation unit 108*c* obtains a cross-correlation value Rcx between the algebraic synthesis signal gan(k,i) and target signal Target(k,i) as well as an autocorrelation value Rcc of the algebraic synthesis signal, then normalizes Rcx by Rcc to find algebraic codebook gain gc2(k) (=Rcx/Rcc). An algebraic codebook gain quantizer 108*d* scalar quantizes the algebraic codebook gain gc2(k) using an EVRC algebraic codebook gain quantization table 108*e*. According to EVRC, 5 bits (32 patterns) per subframe are allocated as quantization bits of algebraic codebook gain. Accordingly, a table value closest to gc2(k) is found from among these 32 table values and the index value prevailing at this time is adopted as an algebraic codebook gain code Gc2(m,k) resulting from the conversion.

The adaptive codebook 106*a* (FIG. 6) is updated after the conversion of pitch-lag code, pitch-gain code, algebraic code and algebraic codebook gain code with regard to one subframe in EVRC. In the initial state, signals all having an amplitude of zero are stored in the adaptive codebook 106*a*. When the processing for subframe conversion is completed, the adaptive codebook updater 106*e* discards a subframe length of the oldest signals from the adaptive codebook, shifts the remaining signals by the subframe length and stores the latest sound-source signal prevailing immediately after conversion in the adaptive codebook. The latest sound-source signal is a sound-source signal that is the result of combining a periodicity sound-source signal conforming to the pitch-lag code lag2(k) and pitch gain gp2(k) after conversion and a noise-like sound-source signal conforming to the algebraic code Cb2(m,k) and algebraic codebook gain gc2(k) after conversion.

Thus, if the LSP code Lsp2(m), pitch-lag code Lag2(m), pitch-gain code Gp2(m,k), algebraic code Cb2(m,k) and algebraic codebook gain code Gc2(m,k) in the EVRC scheme are found, then the code multiplexer 109 multiplexes these codes, combines them into a single code and outputs this code as a voice code CODE2(m) of encoding scheme 2.

According to the first embodiment, the LSP code, pitch-lag code and pitch-gain code are converted in the quantization parameter region. As a result, in comparison with the case where reproduced speech is subjected to LPC analysis and pitch analysis again, analytical error is reduced and parameter conversion with less degradation of sound quality can be carried out. Further, since reproduced speech is not subjected to LSP analysis and pitch analysis again, the problem of prior art 1, namely delay ascribable to code conversion, is solved.

On the other hand, with regard to algebraic code and algebraic codebook gain code, a target signal is created from reproduced speech and a conversion is made so as to minimize error with respect to the target signal. As a result, code conversion with little degradation of sound quality can be performed even in a case where the structure of the algebraic codebook in encoding scheme 1 differs greatly from that of encoding scheme 2. This is a problem that arises in prior art 2.

(C) Second Embodiment

Figure 9:
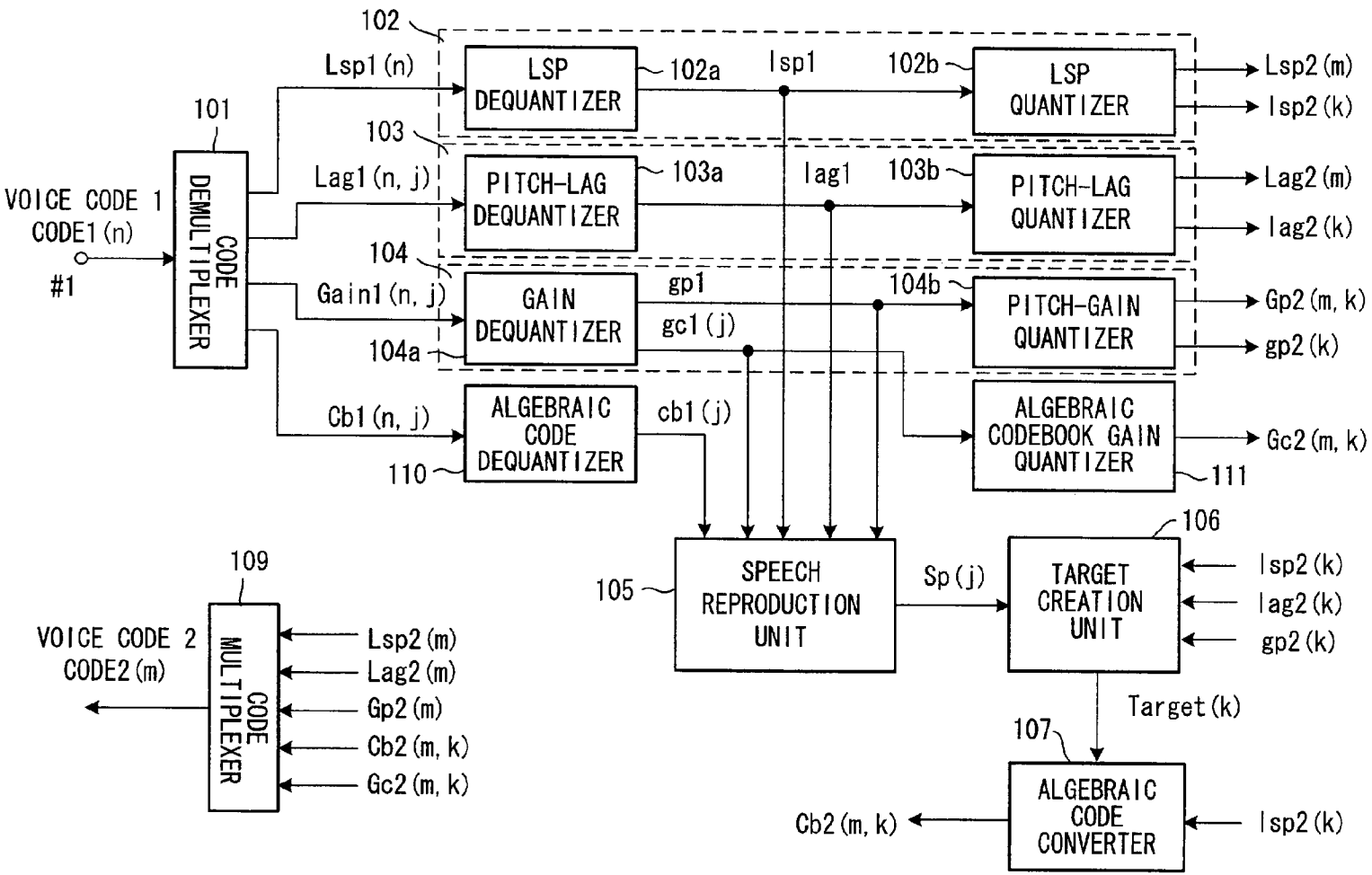
FIG. 9 is a block diagram of the structure of a voice code conversion apparatus according to a second embodiment of the present invention.

FIG. 9 is a block diagram of a voice code conversion apparatus according to a second embodiment of the present invention. Components in FIG. 9 identical with those of the first embodiment shown in FIG. 2 are designated by like reference characters. The second embodiment differs from the first embodiment in that ① the algebraic codebook gain converter 108 of the first embodiment is deleted and substituted by an algebraic codebook gain quantizer 111, and ② the algebraic codebook gain code also is converted in the quantization parameter region in addition to the LSP code, pitch-lag code and pitch-gain code.

In the second embodiment, only the method of converting the algebraic codebook gain code differs from that of the first embodiment. The method of converting the algebraic codebook gain code according to the second embodiment will now be described.

Figure 10:
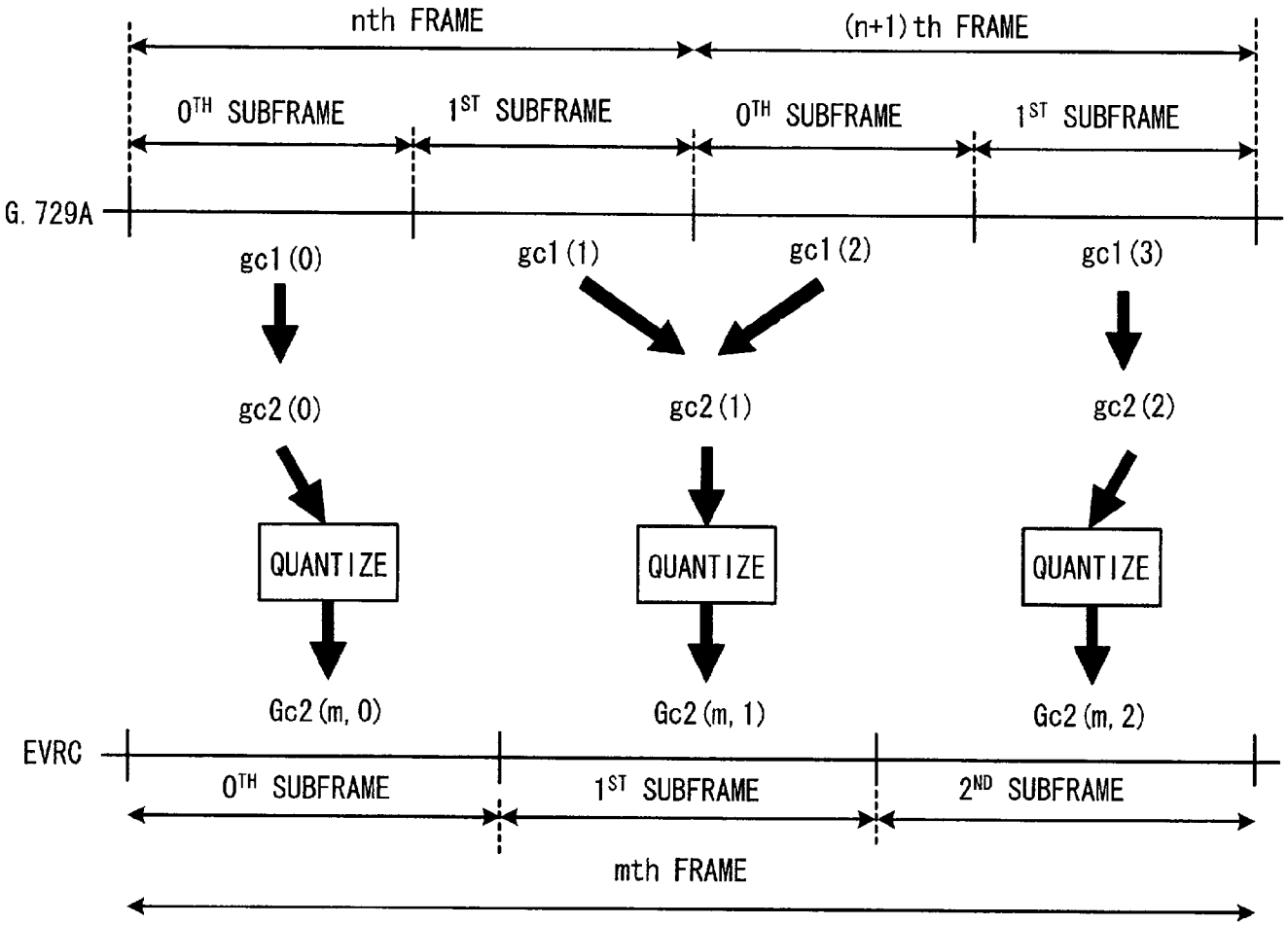
FIG. 10 is a diagram useful in describing conversion of an algebraic codebook gain code.

In G.729A, algebraic codebook gain is quantized ever 5-ms subframe. If 20 ms is considered as the unit time, therefore, G.729A quantizes four algebraic codebook gains in one frame, while EVRC quantizes only three in one frame. Accordingly, in a case where G.729A voice code is converted to EVRC voice code, all algebraic codebook gains in G.729A cannot be converted to EVRC algebraic codebook gain. Accordingly, in the second embodiment, gain conversion is performed by the method illustrated in FIG. 10. Specifically, algebraic codebook gain is synthesized in accordance with the following equations:

$$gc2(0)=gc1(0)$$

$$gc2(1)=[gc1(1)+gc(2)]/2$$

$$gc2(2)=gc1(3)$$

where gc1(0), gc1(1), gc1(2), gc1(3) represent the algebraic codebook gains of two consecutive frames in G.729A. The synthesized algebraic codebook gains gc2(k) (k=0, 1, 2) are scalar quantized using an EVRC algebraic codebook gain quantization table, whereby algebraic codebook gain code Gc2(m,k) is obtained.

According to the second embodiment, the LSP code, pitch-lag code, pitch-gain code and algebraic codebook gain code are converted in the quantization parameter region. As a result, in comparison with the case where reproduced speech is subjected to LPC analysis and pitch analysis again, analytical error is reduced and parameter conversion with less degradation of sound quality can be carried out. Further, since reproduced speech is not subjected to LSP analysis and pitch analysis again, the problem of prior art 1, namely delay ascribable to code conversion, is solved.

On the other hand, with regard to algebraic code, a target signal is created from reproduced speech and a conversion is made so as to minimize error with respect to the target signal.

As a result, code conversion with little degradation of sound quality can be performed even in a case where the structure of the algebraic codebook in encoding scheme 1 differs greatly from that of encoding scheme 2. This is a problem that arises in prior art 2.

(D) Third Embodiment

Figure 11:
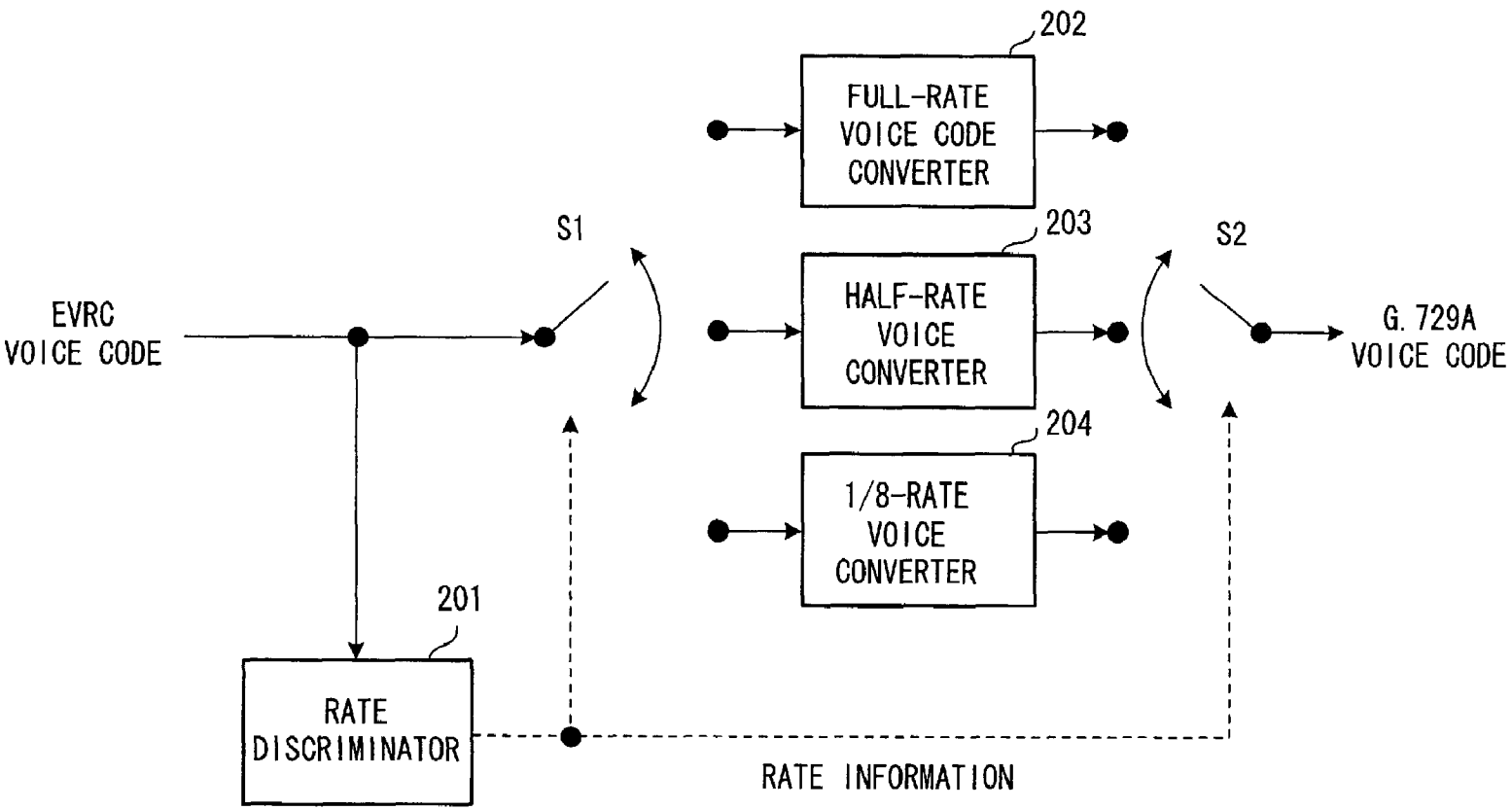
FIG. 11 is a block diagram of the structure of a voice code conversion apparatus according to a third embodiment of the present invention.

FIG. 11 is a block diagram of a voice code conversion apparatus according to a third embodiment of the present invention. The third embodiment illustrates an example of a case where EVRC voice code is converted to G.729A voice code. In FIG. 11, voice code is input to a rate discrimination unit 201 from an EVRC encoder, whereupon the rate discrimination unit 201 discriminates the EVRC rate. Since rate information indicative of the full rate, half rate or ⅛ rate is contained in the EVRC voice code, the rate discrimination unit 201 uses this information to discriminate the EVRC rate. The rate discrimination unit 201 changes over switches S1, S2 in accordance with the rate, inputs the EVRC voice code selectively to prescribed voice code converters 202, 203, 204 for full-, half- and eight-rates, respectively, and sends G.729A voice code, which is output from these voice code converters, to the side of a G.729A decoder.

Voice Code Converter for Full Rate

Figure 12:
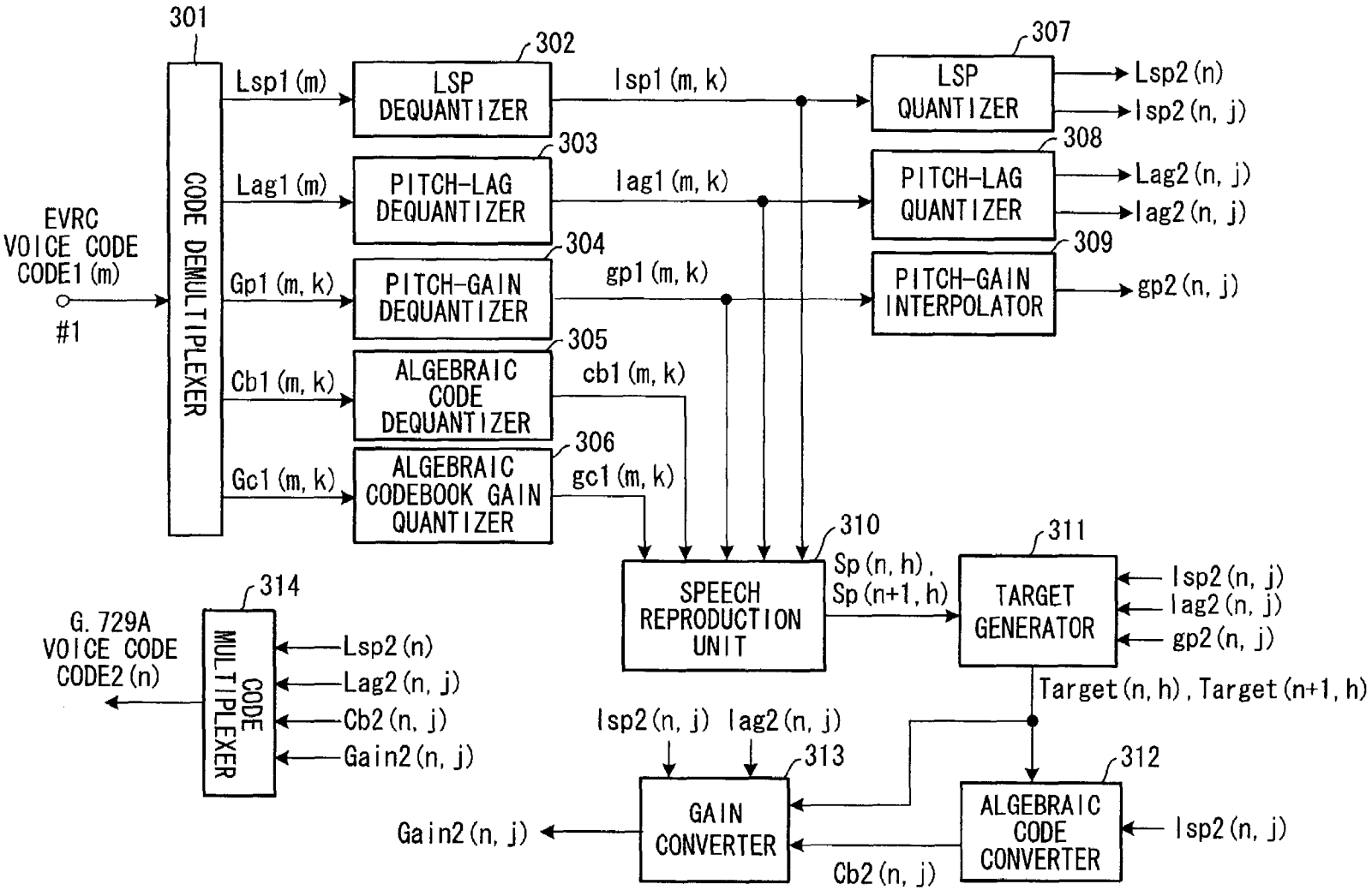
FIG. 12 is a block diagram illustrating the structure of a full-rate voice code converter.

FIG. 12 is a block diagram illustrating the structure of the full-rate voice code converter 202. Since the EVRC frame length is 20 ms and the G.729A frame length is 10 ms, voice code of one frame (the mth frame) in EVRC is converted to two frames [nth and (n+1)th frames] of voice code in G.729A.

An mth frame of voice code (channel data) CODE1(m) is input from an EVRC-compliant encoder (not shown) to terminal #1 via a transmission path. A code demultiplexer 301 demultiplexes LSP code Lsp1(m), pitch-lag code Lag1(m), pitch-gain code Gp1(m,k), algebraic code Cb1(m,k) and algebraic codebook gain code Gc1(m,k) from the voice code CODE1(m) and inputs these codes to dequantizers 302, 303, 304, 305 and 306, respectively. Here "k" represents the number of a subframe in EVRC and takes on a value of 0, 1 or 2.

The LSP dequantizer 302 obtains a dequantized value lsp1(m,2) of the LSP code Lsp1(m) in subframe No. 2. It should be noted that the LSP dequantizer 302 has a quantization table identical with that of the EVRC decoder. Next, by linear interpolation, the LSP dequantizer 302 obtains dequantized values lsp1(m,0) and lsp1(m,1) of subframe Nos. 0, 1 using a dequantized value lsp1(m−1,2) of subframe No. 2 obtained similarly in the preceding frame [(m−1)th frame), and the above-mentioned dequantized value lsp1(m,2), and inputs the dequantized value lsp1(m,1) of subframe No. 1 to an LSP quantizer 307. Using the quantization table of encoding scheme 2 (G.729A), the LSP quantizer 307 quantizes the dequantized value lsp1(m,1) to obtain LSP code Lsp2(n) of encoding scheme 2, and obtains the LSP dequantized value lsp2(n,1) thereof. Similarly, when the LSP quantizer 307 inputs the dequantized value lsp1(m,2) of subframe No. 2 to the LSP quantizer 307, the latter obtains LSP code Lsp2(n+1) of encoding scheme 2 and finds the LSP dequantized value lsp2(n+1,1) thereof. Here it is assumed that the LSP dequantizer 302 has a quantization table identical with that of G.729A.

Next, the LSP quantizer 307 finds the dequantized value lsp2(n,0) of subframe No. 0 by linear interpolation between the dequantized value lsp2(n−1,1) obtained in the preceding frame [(n−1)th frame] and the dequantized value lsp2(n,1) of the present frame. Further, the LSP quantizer 307 finds the dequantized value lsp2(n+1,0) of subframe No. 0 by linear interpolation between the dequantized value lsp2(n,1) and the dequantized value lsp2(nb+1,1). These dequantized values lsp2(n,j) are used in creation of the target signal and in conversion of the algebraic code and gain code.

The pitch-lag dequantizer 303 obtains a dequantized value lag1(m,2) of the pitch-lag code Lag1(m) in subframe No. 2, then obtains dequantized values lag1(m,0) and lag1(m,1) of subframe Nos. 0, 1 by linear interpolation between the dequantized value lag1(m,2) and a dequantized value lag1(m−1,2) of subframe No. 2 obtained in the (m−1)th frame. Next, the pitch-lag dequantizer 303 inputs the dequantized value lag1(m,1) to a pitch-lag quantizer 308. Using the quantization table of encoding scheme 2 (G.729A), the pitch-lag quantizer 308 obtains pitch-lag code Lag2(n) of encoding scheme 2 corresponding to the dequantized value lag(m,1) and obtains the dequantized value lag2(n,1) thereof. Similarly, the pitch-lag dequantizer 303 inputs the dequantized value lag1(m,2) to the pitch-lag quantizer 308, and the latter obtains pitch-lag code Lag2(n+1) and finds the LSP dequantized value lag2(n+1,1) thereof. Here it is assumed that the pitch-lag quantizer 308 has a quantization table identical with that of G.729A.

Next, the pitch-lag quantizer 308 finds the dequantized value lag2(n,0) of subframe No. 0 by linear interpolation between the dequantized value lag2(n−1,1) obtained in the preceding frame [(n−1)th frame] and the dequantized value lag2(n,1) of the present frame. Further, the pitch-lag quantizer 308 finds the dequantized value lag2(n+1,0) of subframe No. 0 by linear interpolation between the dequantized value lag2(n,1) and the dequantized value lag2(n+1,1). These dequantized values lag2(n,j) are used in creation of the target signal and in conversion of the gain code.

The pitch-gain dequantizer 304 obtains dequantized values gp1(m,k) of three pitch gains Gp1(m,k) (k=0, 1, 2) in the mth frame of EVRC and inputs these dequantized values to a pitch-gain interpolator 309. Using the dequantized values gp1(m,k), the pitch-gain interpolator 309 obtains, by interpolation, pitch-gain dequantized values gp2(n,j) (j=0, 1), gp2(n+1,j) (j=0, 1) in encoding scheme 2 (G.729A) in accordance with the following equations:

$$gp2(n,0)=gp1(m,0) \tag{1}$$

$$gp2(n,1)=[gp1(m,0)+gp1(m,1)]/2 \tag{2}$$

$$gp2(n+1,0)=[gp1(m,1)+gp1(m,2)]/2 \tag{3}$$

$$gp2(n+1,1)=gp1(m,2) \tag{4}$$

It should be noted that the pitch-gain dequantized values gp2(n,j) are not directly required in conversion of the gain code but are used in the generation of the target signal.

The dequantized values lsp1(m,k), lag1(m,k), gp1(m,k), cb1(m,k) and gc1(m,k) of each of the EVRC codes are input to the speech reproducing unit 310, which creates EVRC-compliant reproduced speech SP(k,i) of a total of 160 samples in the mth frame, partitions these regenerated signals into two G.729A-speech signals Sp(n,h), Sp(n+1,h), of 80 samples each, and outputs the signals. The method of creating reproduced speech is the same as that of an EVRC decoder and is well known; no further description is given here.

A target generator 311 has a structure similar to that of the target generator (see FIG. 6) according to the first embodiment and creates target signals Target(n,h), Target(n+1,h) used by an algebraic code converter 312 and algebraic codebook gain converter 313. Specifically, the target generator 311 first obtains an adaptive codebook output that corresponds to pitch lag lag2(n,j) found by the pitch-lag quantizer 308 and multiplies this by pitch gain gp2(n,j) to create a sound-source signal. Next, the target generator 311 inputs the sound-source signal to an LPC synthesis filter constituted by the LSP dequantized value lsp2(n,j), thereby creating an adaptive codebook synthesis signal syn(n,h). The target generator 311 then subtracts the adaptive codebook synthesis signal syn(n,h) from the reproduced speech Sp(n,h) created by the speech reproducing unit 310, thereby obtaining the target signal Target(n,h). Similarly, the target generator 311 creates the target signal Target(n+1,h) of the (n+1)th frame.

The algebraic code converter 312, which has a structure similar to that of the algebraic code converter (see FIG. 7) according to the first embodiment, executes processing exactly the same as that of an algebraic codebook search in G.729A. First, the algebraic code converter 312 inputs an algebraic codebook output signal that can be produced by a combination of pulse positions and polarity shown in FIG. 18 to an LPC synthesis filter constituted by the LSP dequantized value lsp2(n,j), thereby creating an algebraic synthesis signal. Next, the algebraic code converter 312 calculates a cross-correlation value Rcx between the algebraic synthesis signal and target signal as well as an autocorrelation value Rcc of the algebraic synthesis signal, and searches for an algebraic code Cb2(n,j) that will afford the largest normalized cross-correlation value Rcx·Rcx/Rcc obtained by normalizing the square of Rcx by Rcc. The algebraic code converter 312 obtains algebraic code Cb2(n+1,j) in similar fashion.

The gain converter 313 performs gain conversion using the target signal Target(n,h), pitch lag lag2(n,j), algebraic code Cb2(n,j) and LSP dequantized value lsp2(n,j). The conversion method is the same as that of gain quantization performed in a G.729A encoder. The procedure is as follows:

(1) Extract a set of table values (pitch gain and correction coefficient γ of algebraic codebook gain) from a G.729A gain quantization table;

(2) multiply an adaptive codebook output by the table value of the pitch gain, thereby creating a signal X;

(3) multiply an algebraic codebook output by the correction coefficient γ and a gain prediction value g', thereby creating a signal Y;

(4) input a signal, which is obtained by adding signal X and signal Y, to an LPC synthesis filter constituted by an LSP dequantized value lsp2(n,j), thereby creating a synthesized signal Z;

(5) calculate error power E between the target signal and synthesized signal Z; and (6) apply the processing of (1) to (5) above to all table values of the gain quantization table, decide a table value that will minimize the error power E, and adopt the index thereof as gain code Gain2(n,j). Similarly, gain code Gain2(n+1,j) is found from target signal Target(n+1,h), pitch lag lag2(n+1,j), algebraic code Cb2(n+1,j) and LSP dequantized value lsp2(n+1,j).

Thereafter, a code multiplexer 314 multiplexes the LSP code Lsp2(n), pitch-lag code Lag2(n), algebraic code Cb2(n,j) and gain code Gain2(n,j) and outputs the voice code CODE2 in the nth frame. Further, the code multiplexer 314 multiplexes LSP code Lsp2(n+1), pitch-lag code Lag2(n+1), algebraic code Cb2(n+1,j) and gain code Gain2(n+1,j) and outputs the voice code CODE2 in the (n+1)th frame of G.729A.

In accordance with the third embodiment, as described above, EVRC (full-rate) voice code can be converted to G.729A voice code.

Voice Code Converter for Half Rate

A full-rate coder/decoder and a half-rate coder/decoder differ only in the sizes of their quantization tables; they are almost identical in structure. Accordingly, the half-rate voice code converter 203 also can be constructed in a manner similar to that of the above-described full-rate voice code converter 202, and half-rate voice code can be converted to G.729A voice code in a similar manner.

Voice Code Converter for ⅛ Rate

Figure 13:
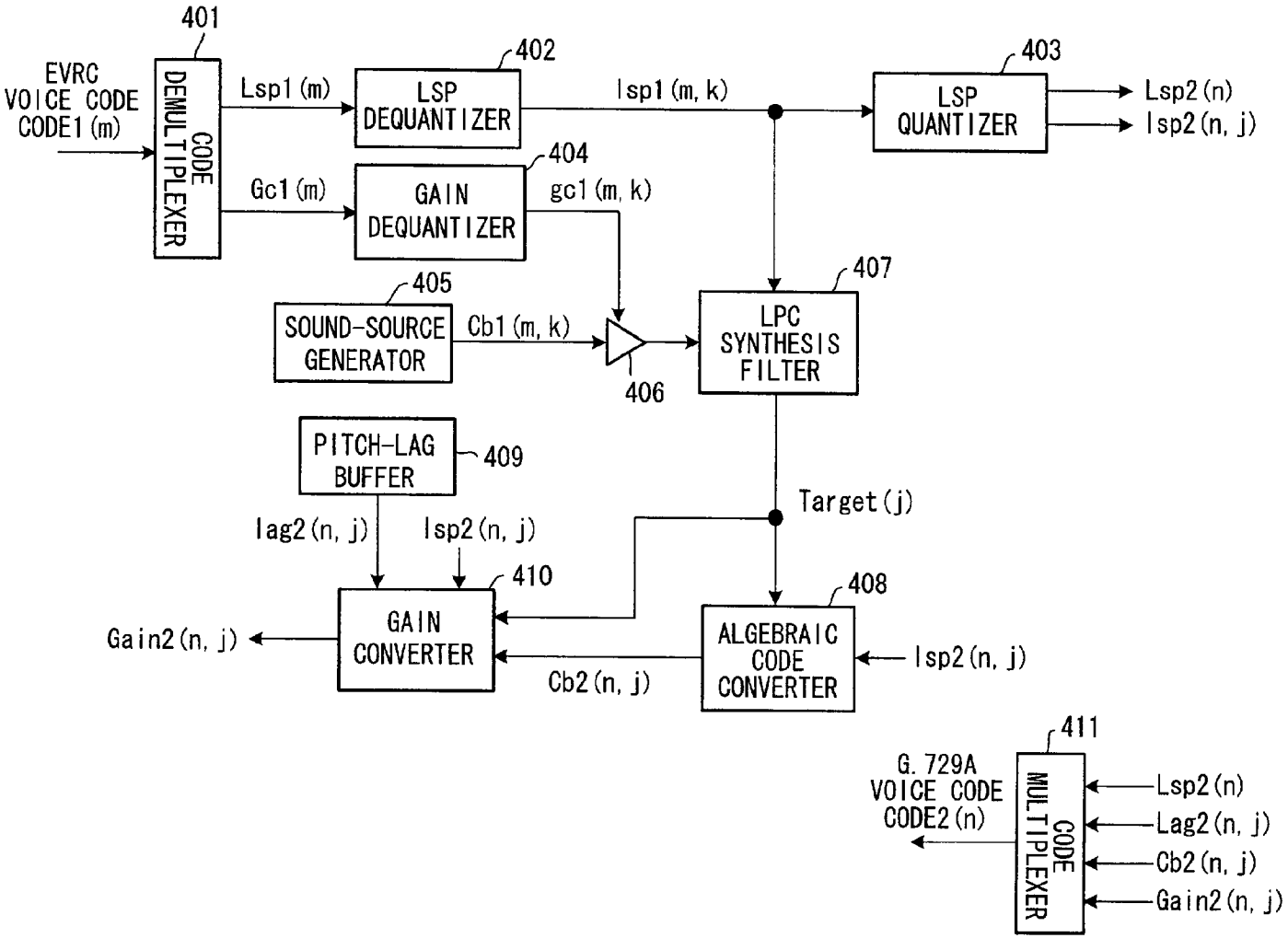
FIG. 13 is a block diagram illustrating the structure of a ⅛-rate voice code converter.

FIG. 13 is a block diagram illustrating the structure of the ⅛-rate voice code converter 204. The ⅛ rate is used in unvoiced intervals such as silent segments or background-noise segments. Further, information transmitted in the ⅛ rate is composed of a total of 16 bits, namely an LSP code (8 bits/frame) and a gain code (8 bits/frame), and a sound-source signal is not transmitted because the signal is generated randomly within the encoder and decoder.

When voice code CODE1(m) in an mth frame of EVRC (⅛ rate) is input to a code demultiplexer 401 in FIG. 13, the latter demultiplexes the LSP code Lsp1(m) and gain code Gc1(m). An LSP dequantizer 402 and an LSP quantizer 403 convert the LSP code Lsp1(m) in EVRC to LSP code Lsp2(n) in G.729A in a manner similar to that of the full-rate case shown in FIG. 12. The LSP dequantizer 402 obtains an LSP-code dequantized value lsp1(m,k), and the LSP quantizer 403 outputs the G.729A LSP code Lsp2(n) and finds an LSP-code dequantized value lsp2(n,j).

A gain dequantizer 404 finds a gain quantized value gc1(m,k) of the gain code Gc1(m). It should be noted that only gain with respect to a noise-like sound-source signal is used in the ⅛-rate mode; gain (pitch gain) with respect to a periodic sound source is not used in the ⅛-rate mode.

In the case of the ⅛ rate, the sound-source signal is used upon being generated randomly within the encoder and decoder. Accordingly, in the voice code converter for the ⅛ rate, a sound-source generator 405 generates a random signal in a manner similar to that of the EVRC encoder and decoder, and a signal so adjusted that the amplitude of this random signal will become a Gaussian distribution is output as a sound-source signal Cb1(m,k). The method of generating the random signal and the method of adjustment for obtaining the Gaussian distribution are methods similar to those used in EVRC.

A gain multiplier 406 multiplies Cb1(m,k) by the gain dequantized value gc1(m,k) and inputs the product to an LPC synthesis filter 407 to create target signals Target(n,h), Target(n+1,h). The LPC synthesis filter 407 is constituted by the LSP-code dequantized value lsp1(m,k).

An algebraic code converter 408 performs an algebraic code conversion in a manner similar to that of the full-rate case in FIG. 12 and outputs G.729A-compliant algebraic code Cb2(n,j).

Since the EVRC ⅛ rate is used in unvoiced intervals such as silent or noise segments that exhibit almost no periodicity, a pitch-lag code does not exist. Accordingly, a pitch-lag code for G.729A is generated by the following method: The ⅛-rate voice code converter 204 extracts G.729A pitch-lag code obtained by the pitch-lag quantizer 308 of the full-rate or half-rate voice code converter 202 or 203 and stores the code in a pitch-lag buffer 409. If the ⅛ rate is selected in the present frame (nth frame), pitch-lag code Lag2(n,j) in the pitch-lag buffer 409 is output. The content stored in the pitch-lag buffer 409, however, is not changed. On the other hand, if the ⅛ rate is not selected in the present frame, then G.729A pitch-lag code obtained by the pitch-lag quantizer 308 of the voice code converter 202 or 203 of the selected rate (full rate or half rate) is stored in the buffer 409.

A gain converter 410 performs a gain code conversion similar to that of the full-rate case in FIG. 12 and outputs the gain code Gc2(n,j).

Thereafter, a code multiplexer 411 multiplexes the LSP code Lsp1(n), pitch-lag code Lag2(n), algebraic code Cb2(n, j) and gain code Gain2(n,j) and outputs the voice code CODE2(n+1) in the nth frame of G.729A.

Thus, as set forth above, EVRC (⅛-rate) voice code can be converted to G.729A voice code.

(E) Fourth Embodiment

Figure 14:
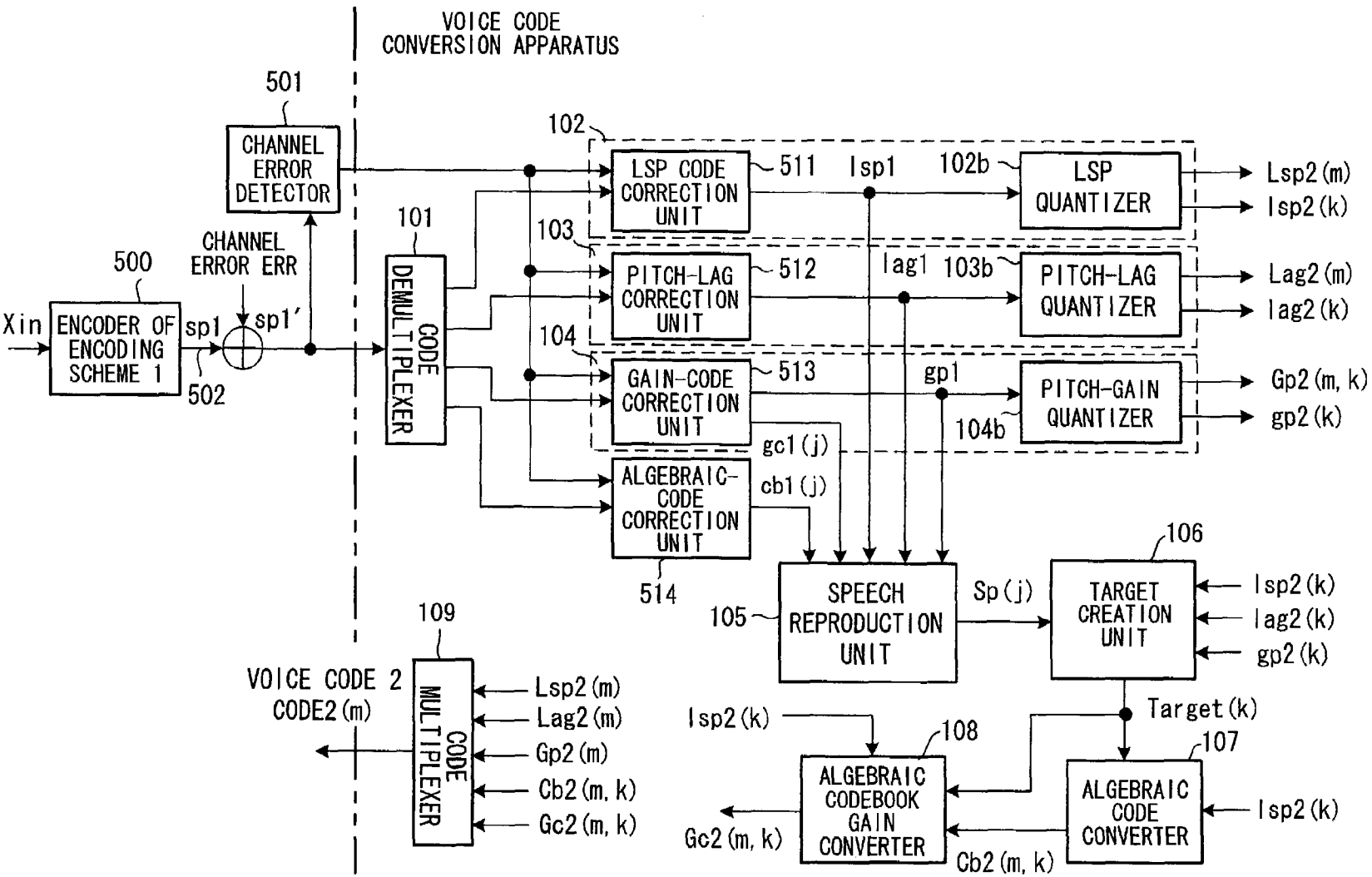
FIG. 14 is a block diagram of the structure of a voice code conversion apparatus according to a fourth embodiment of the present invention.
Figure 15:
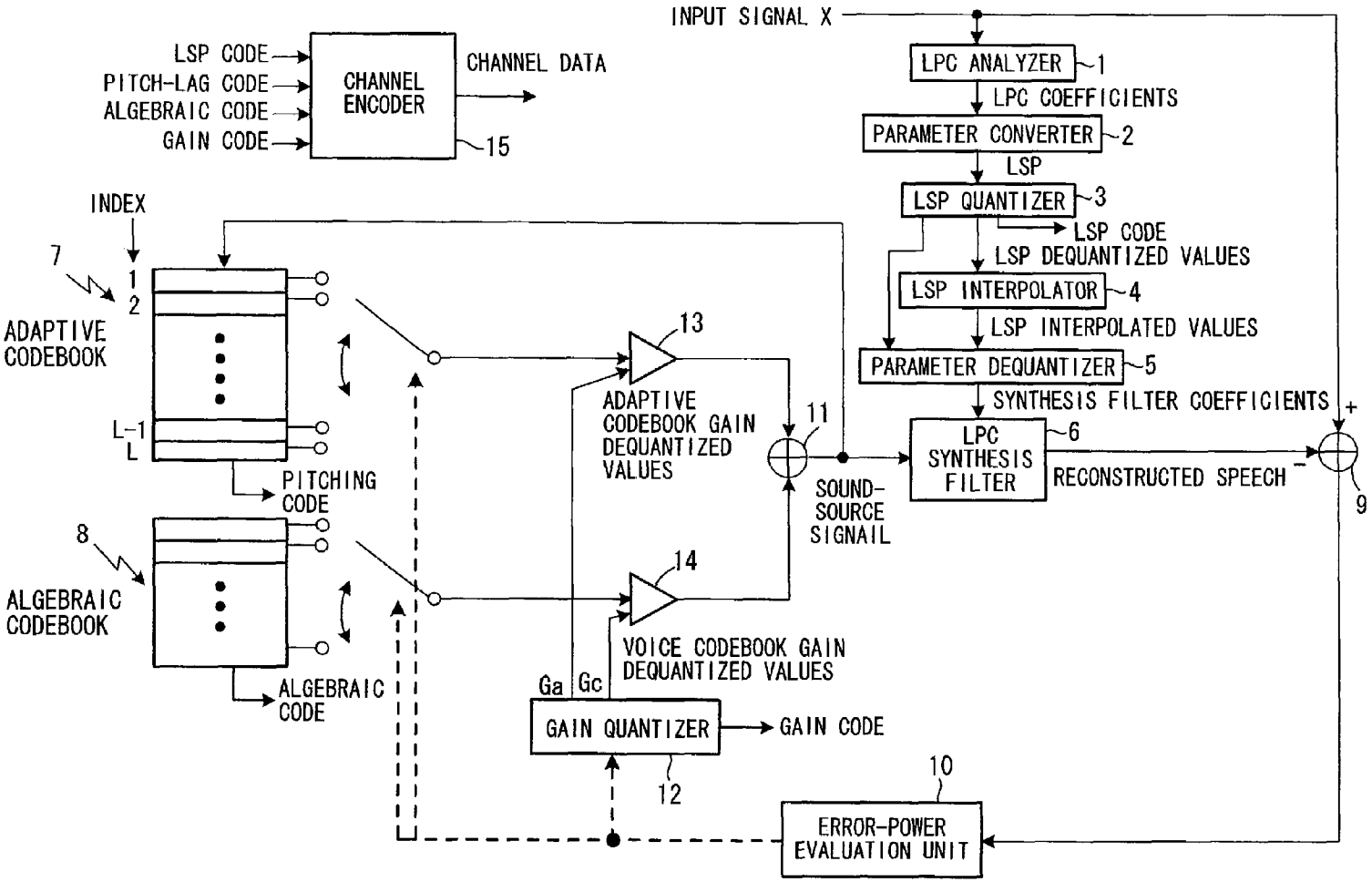
FIG. 15 PRIOR ART
FIG. 15 is a block diagram of an encoder based upon ITU-T Recommendation G.729A according to the prior art.
Figure 16:
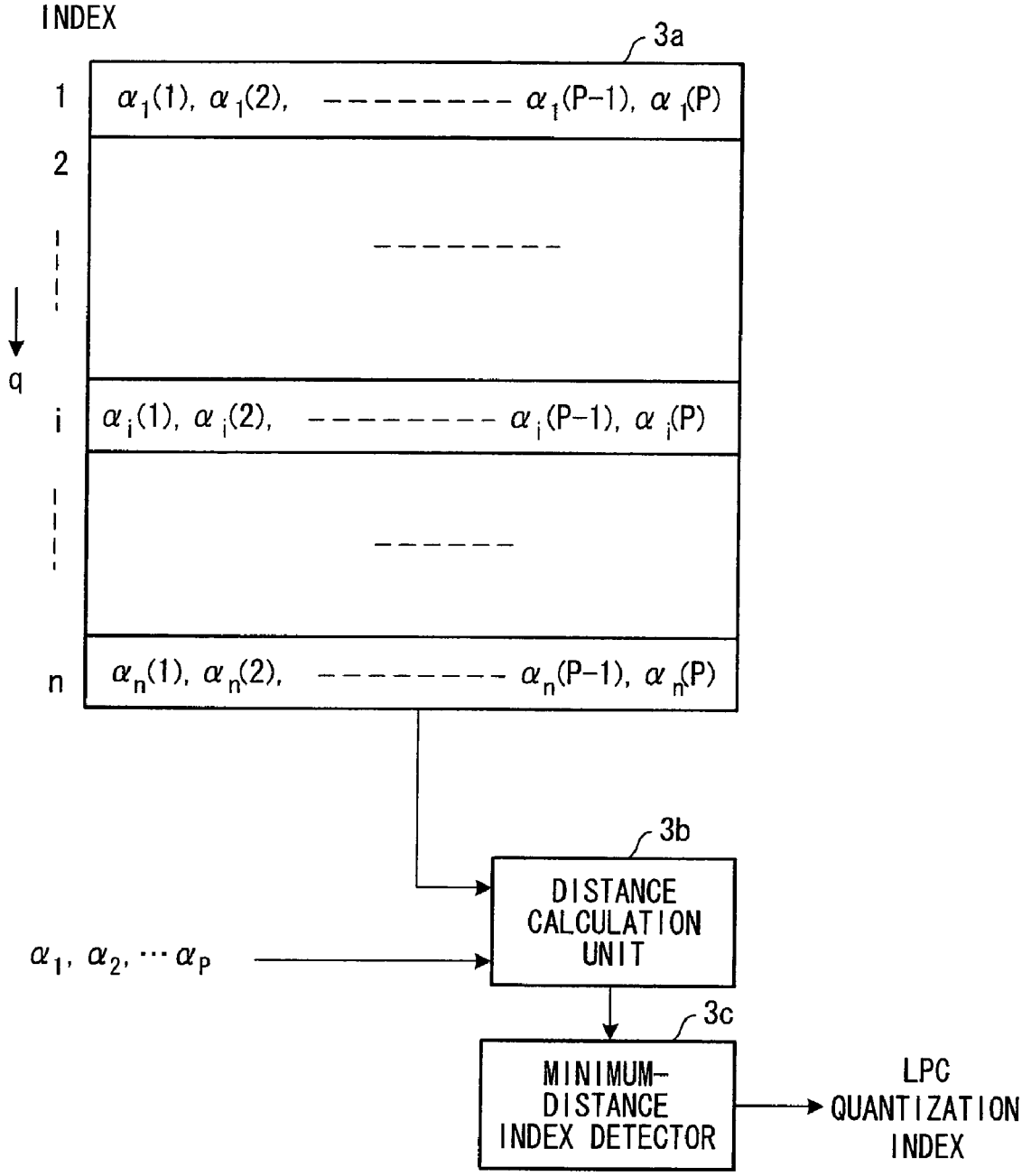
FIG. 16 PRIOR ART
FIG. 16 is a diagram useful in describing a quantization method according to the prior art.
Figure 17:
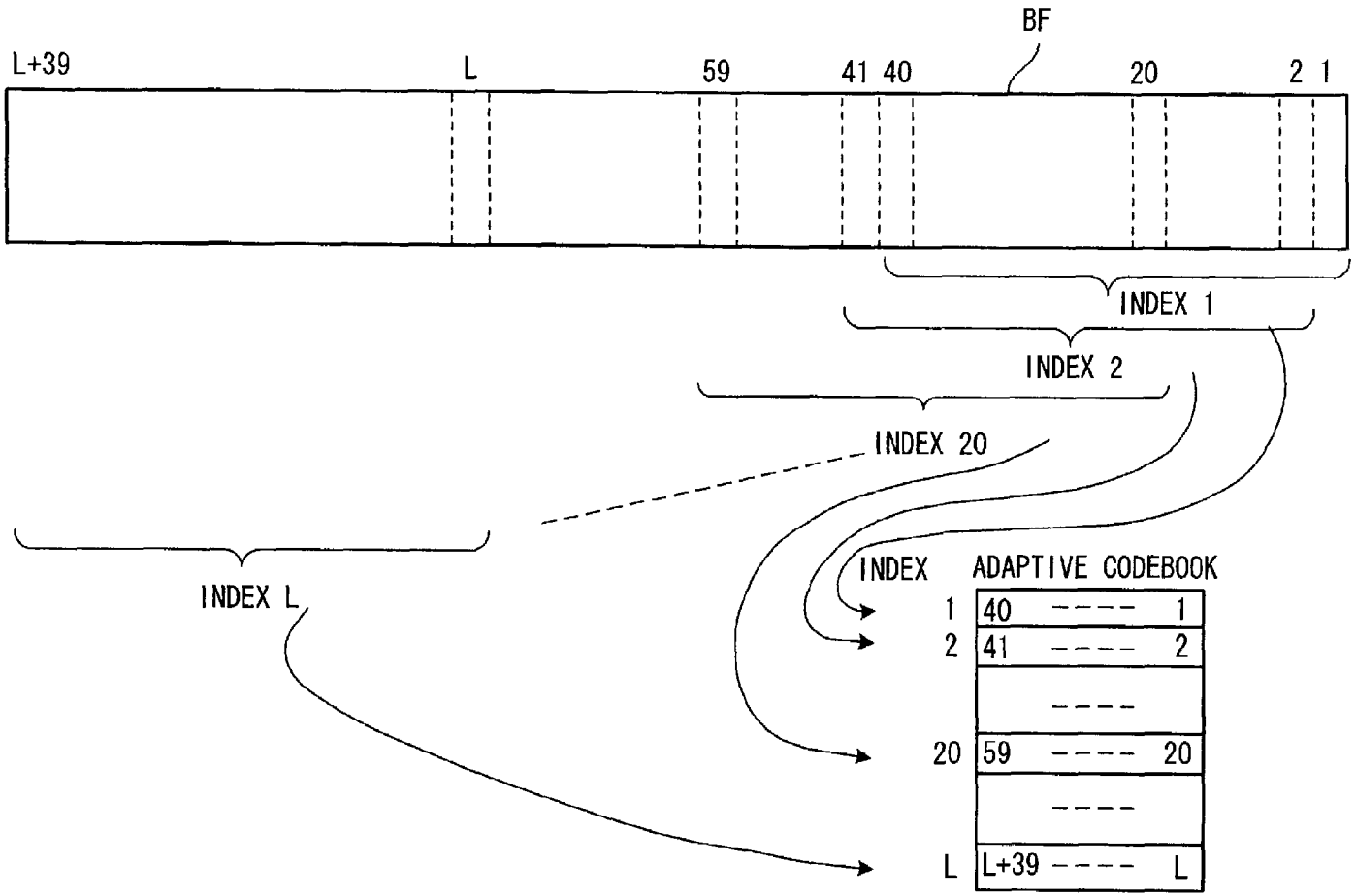
FIG. 17 PRIOR ART
FIG. 17 is a diagram useful in describing the structure of an adaptive codebook according to the prior art.
Figure 19:
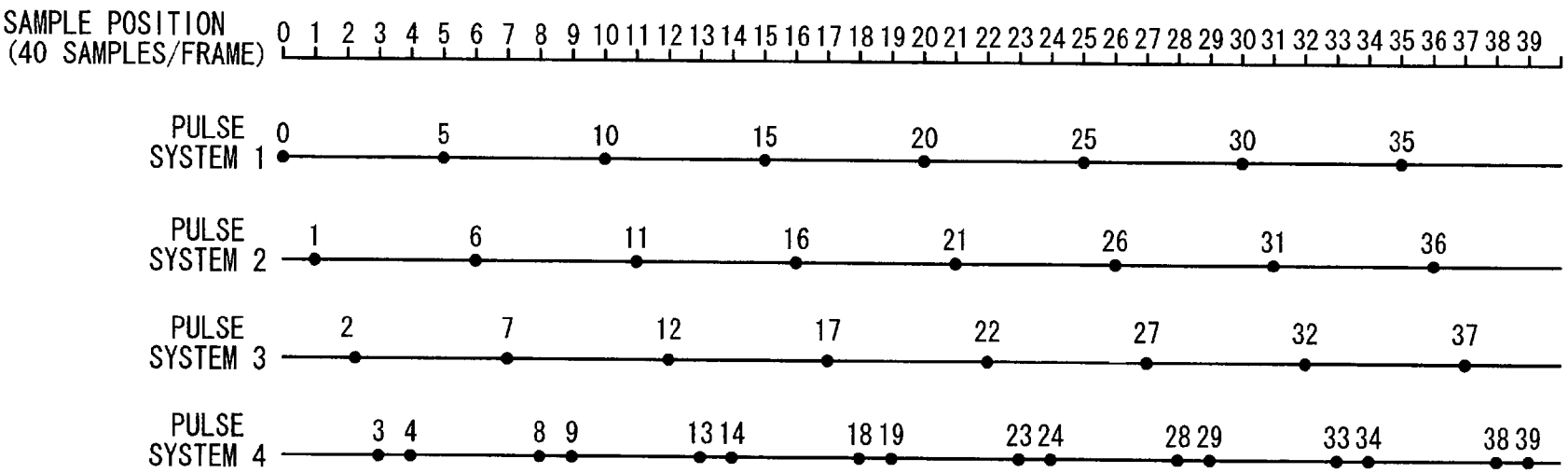
FIG. 19 PRIOR ART
FIG. 19 is a diagram useful in describing sampling points of pulse-system groups according to the prior art.
Figure 20:
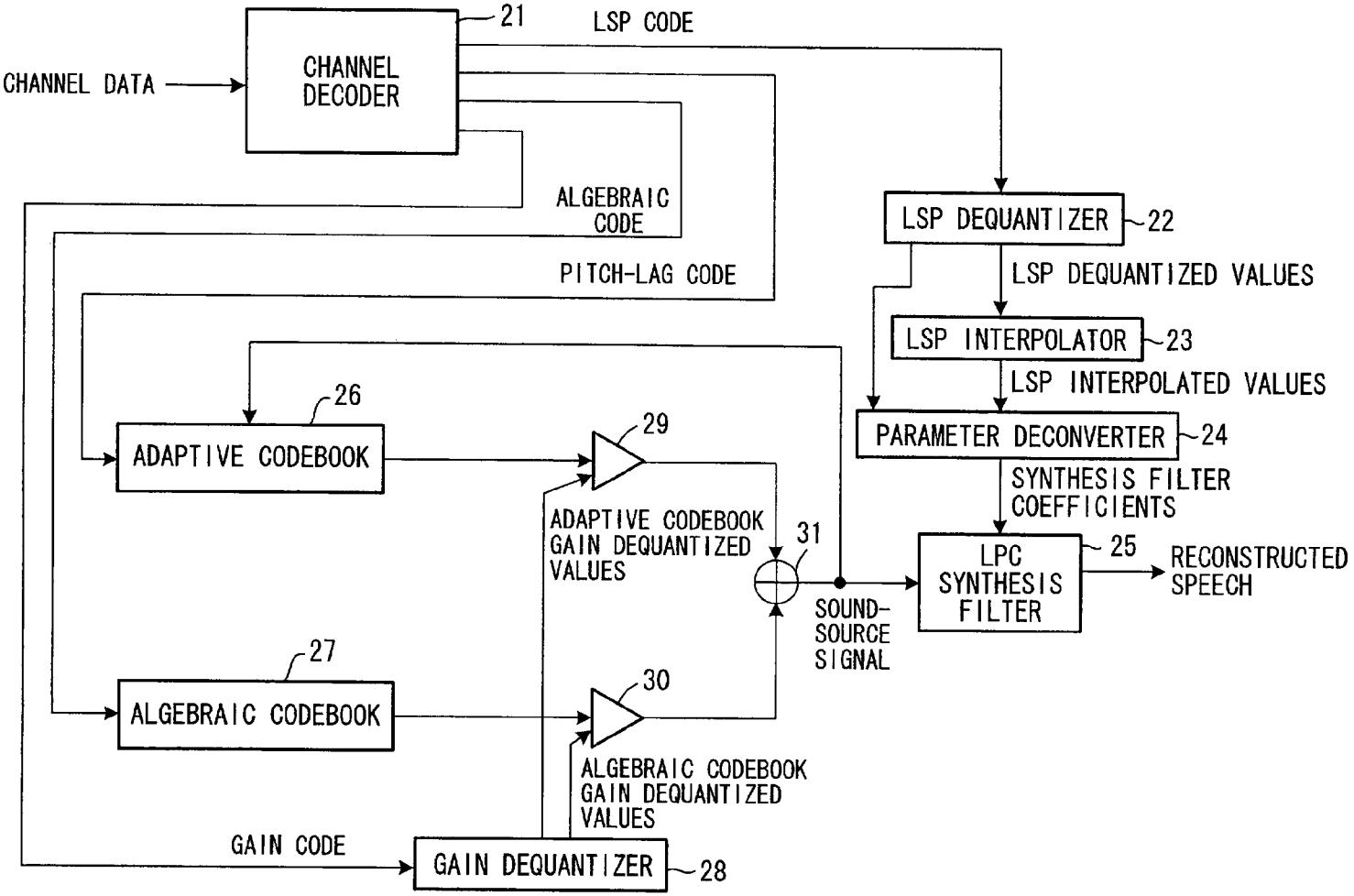
FIG. 20 PRIOR ART
FIG. 20 is a block diagram of a decoder based upon G.729A according to the prior art.
Figure 21:
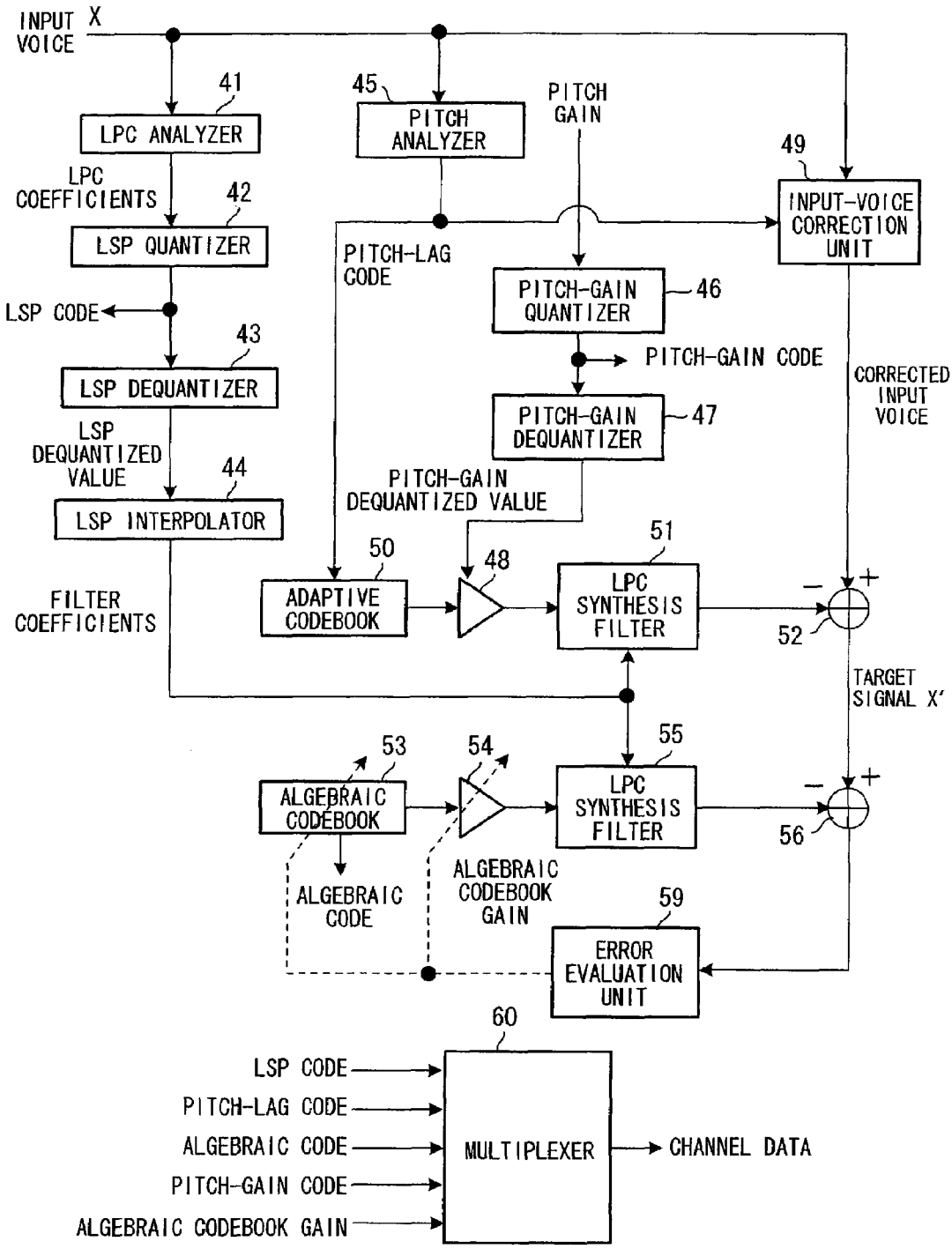
FIG. 21 PRIOR ART
FIG. 21 is a block diagram showing the structure of an EVRC encoder according to the prior art.
Figure 22:
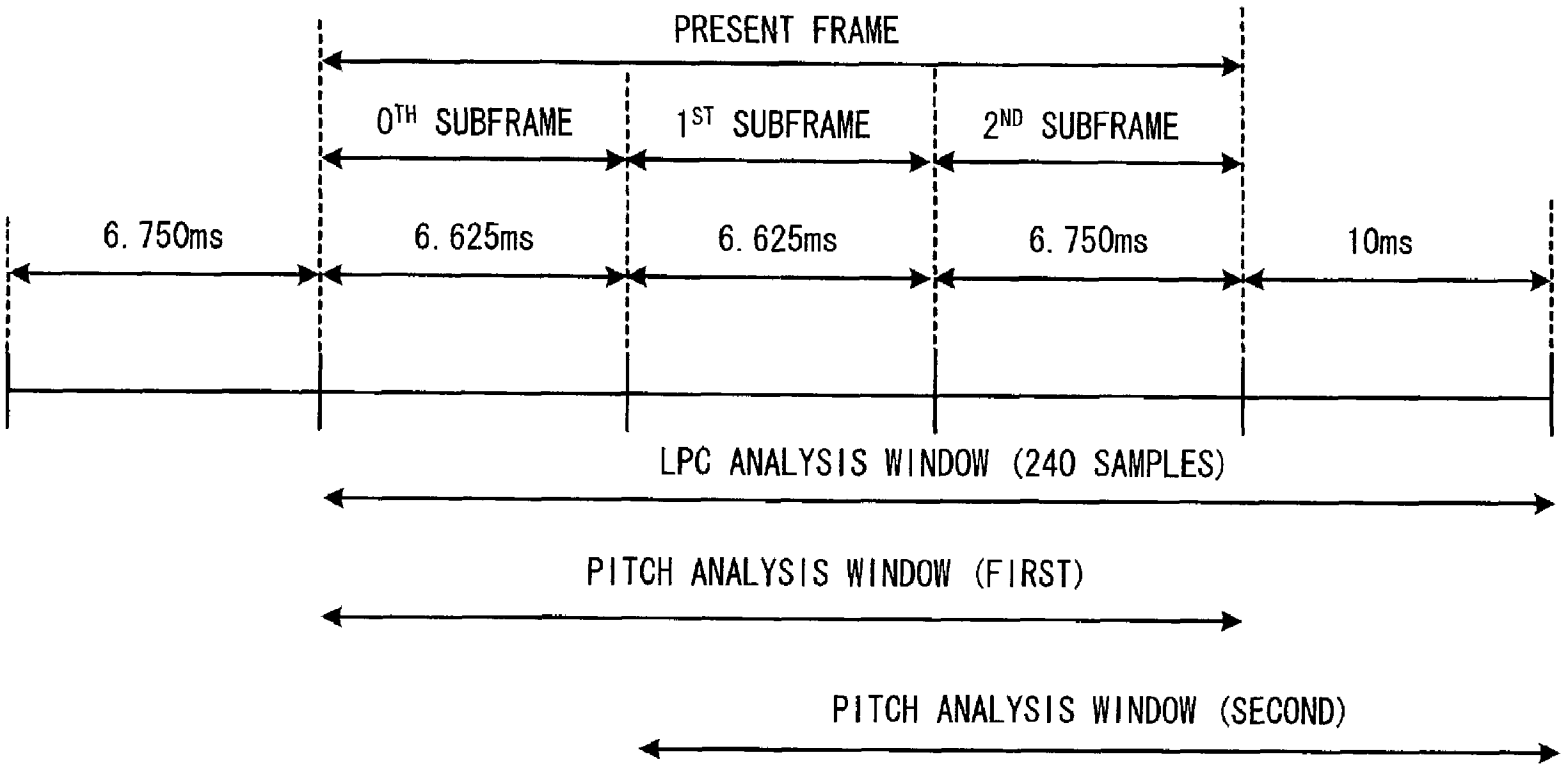
FIG. 22 PRIOR ART
FIG. 22 is a diagram useful in describing the relationship between an EVRC-compliant frame and an LPC analysis window and pitch analysis window according to the prior art.
Figure 23:
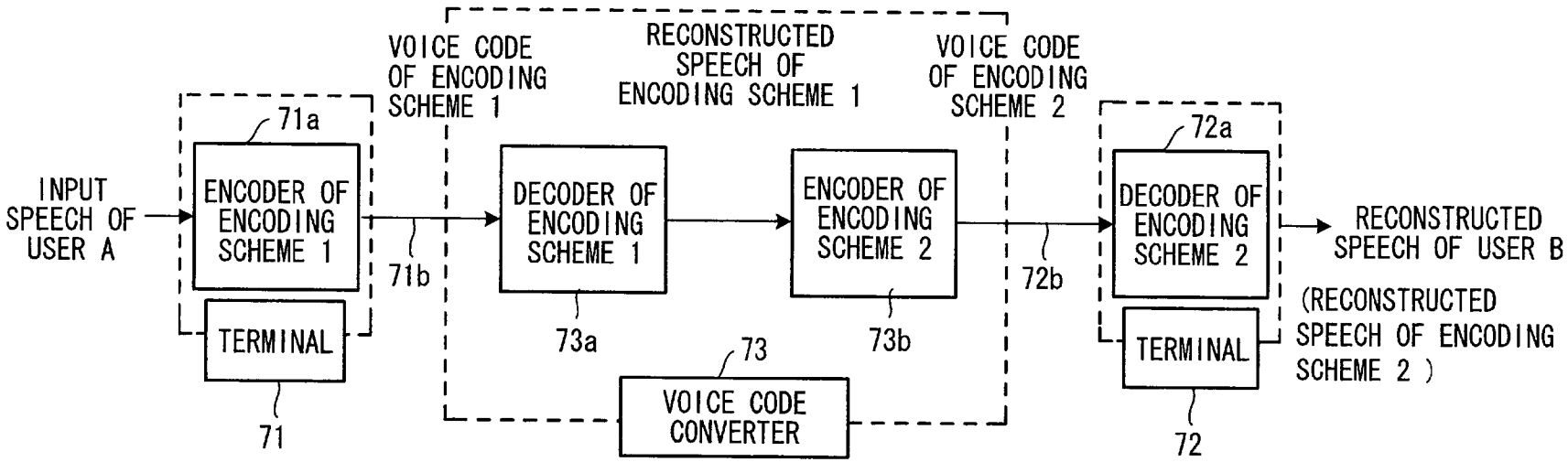
FIG. 23 PRIOR ART
FIG. 23 is a diagram illustrating the principles of a typical voice code conversion method according to the prior art.
Figure 24:
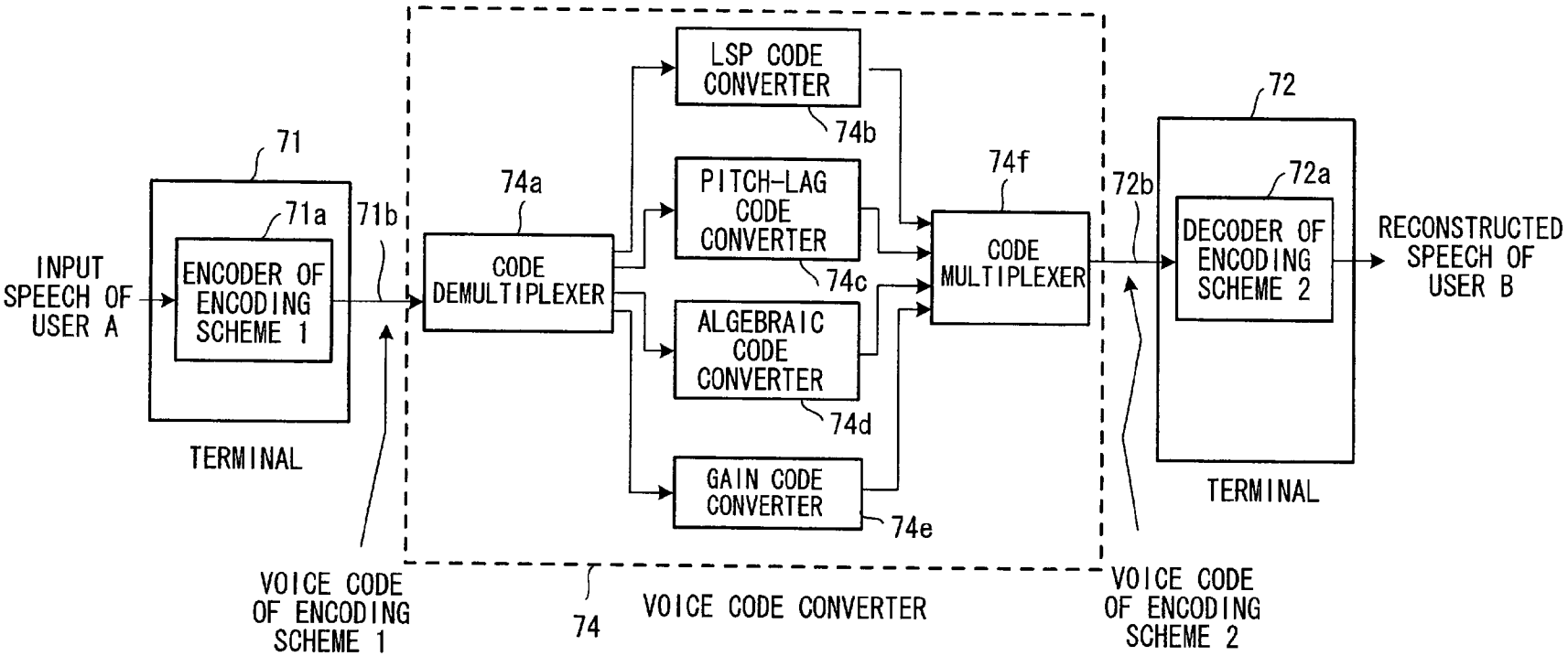
FIG. 24 PRIOR ART
FIG. 24 is a block diagram of a voice encoding apparatus according to prior art 1.
Figure 25:
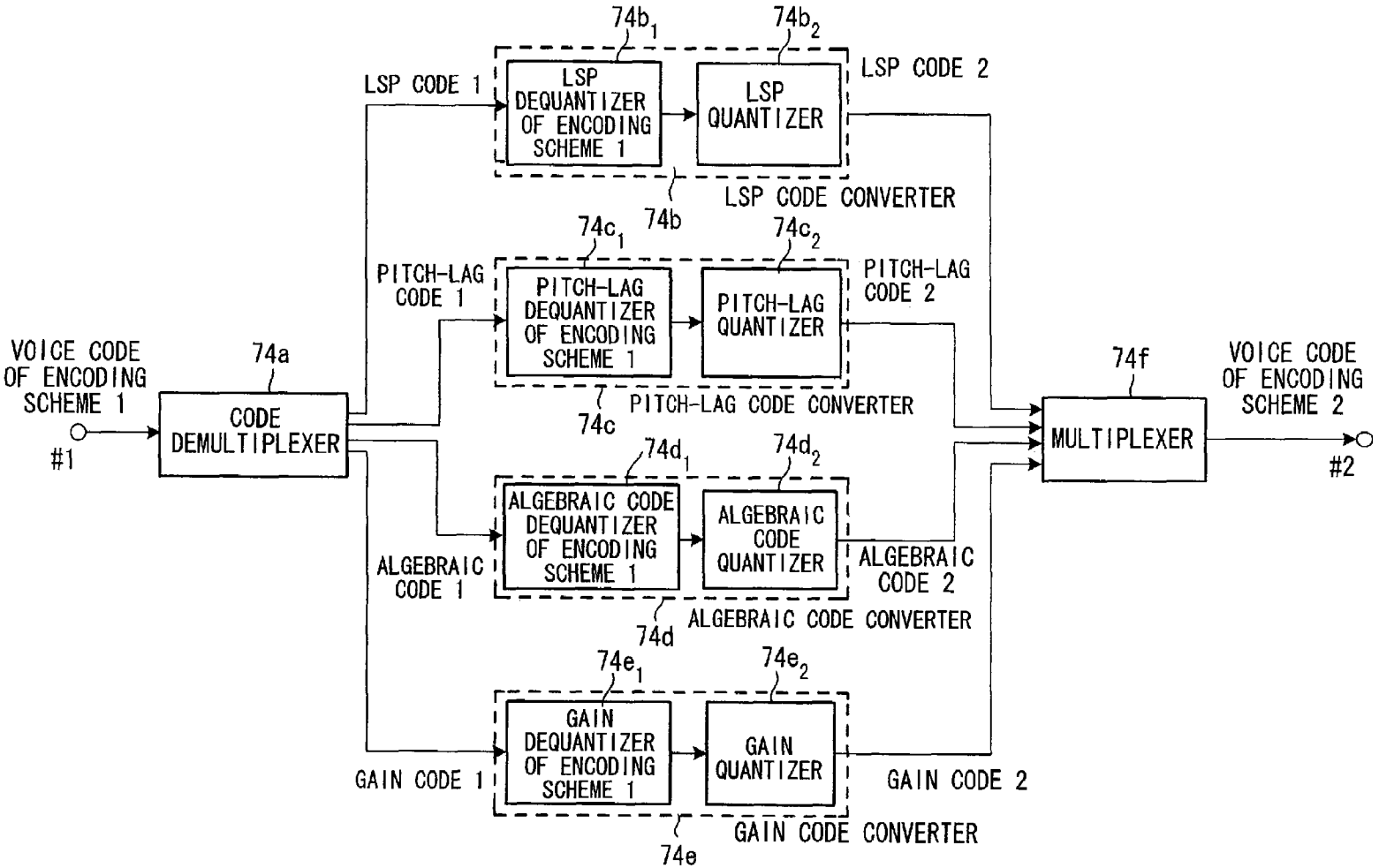
FIG. 25 PRIOR ART
FIG. 25 is a block diagram showing the details of a voice encoding apparatus according to prior art 2.

FIG. 14 is a block diagram of a voice code conversion apparatus according to a fourth embodiment of the present invention. This embodiment is adapted so that it can deal with voice code develops a channel error. Components in FIG. 14 identical with those of the first embodiment shown in FIG. 2 are designated by like reference characters. This embodiment differs in that ① a channel error detector 501 is provided, and ② an LSP code correction unit 511, pitch-lag correction unit 512, gain-code correction unit 513 and algebraic-code correction unit 514 are provided instead of the LSP dequantizer 102*a*, pitch-lag dequantizer 103*a*, gain dequantizer 104*a* and algebraic gain quantizer 110.

When input voice xin is applied to an encoder 500 according to encoding scheme 1 (G.729A), the encoder 500 generates voice code sp1 according to encoding scheme 1. The voice code sp1 is input to the voice code conversion apparatus through a transmission path such as a wireless channel or wired channel (Internet, etc.). If channel error ERR develops before the voice code sp1 is input to the voice code conversion apparatus, the voice code sp1 is distorted to voice code sp1' that contains channel error. The pattern of channel error ERR depends upon the system, and the error takes on various patterns such as random bit error and bursty error. It should be noted that sp1' and sp1 become exactly the same code if the voice code contains no error. The voice code sp1' is input to the code demultiplexer 101, which demultiplexes LSP code Lsp1(n), pitch-lag code Lag1(n,j), algebraic code Cb1 (n,j) and pitch-gain code Gain1(n,j). Further, the voice code sp1' is input to the channel error detector 501, which detects whether channel error is present or not by a well-known method. For example, channel error can be detected by adding a CRC code onto the voice code sp1.

If error-free LSP code Lsp1(n) enters the LSP code correction unit 511, the latter outputs the LSP dequantized value lsp1 by executing processing similar to that executed by the LSP dequantizer 102*a* of the first embodiment. On the other hand, if a correct Lsp code cannot be received in the present frame owing to channel error or a lost frame, then the LSP code correction unit 511 outputs the LSP dequantized value lsp1 using the last four frames of good Lsp code received.

If there is no channel error or loss of frames, the pitch-lag correction unit 512 outputs the dequantized value lag1 of the pitch-lag code in the present frame received. If channel error or loss of frames occurs, however, the pitch-lag correction unit 512 outputs a dequantized value of the pitch-lag code of the last good frame received. It is known that pitch lag generally varies smoothly in a voiced segment. In a voiced segment, therefore, there is almost no decline in sound quality even if pitch lag of the preceding frame is substituted. Further, it is known that pitch lag varies greatly in an unvoiced segment. However, since the rate of contribution of an adaptive codebook in an unvoiced segment is small (the pitch gain is small), there is almost no decline in sound quality ascribable to the above-described method.

If there is no channel error or loss of frames, the gain-code correction unit 513 obtains the pitch gain gp1(j) and algebraic codebook gain gc1(j) from the received gain code Gain1(n,j) of the present frame in a manner similar to that of the first embodiment. In the case of channel error or frame loss, on the other hand, the gain code of the present frame cannot be used. Accordingly, the gain-code correction unit 513 attenuates the stored gain that prevailed one subframe earlier in accordance with the following equations:

$$gp1(n,0)=\alpha\cdot gp1(n-1,1)$$

$$gp1(n,1)=\alpha\cdot gp1(n-1,0)$$

$$gc1(n,0)=\beta\cdot gc1(n-1,1)$$

$$gc1(n,1)=\beta\cdot gc1(n-1,0)$$

obtains pitch gain gp1(n,j) and algebraic codebook gain gc1 (n,j) and outputs these gains. Here α, β represent constants of less than 1.

If there is no channel error or loss of frames, the algebraic-code correction unit 514 outputs the dequantized value cbi(j) of the algebraic code of the present frame received. If there is channel error or loss of frames, then the algebraic-code correction unit 514 outputs the dequantized value of the algebraic code of the last good frame received and stored.

Thus, in accordance with the present invention, an LSP code, pitch-lag code and pitch-gain code are converted in a quantization parameter region or an LSP code, pitch-lag code, pitch-gain code and algebraic codebook gain code are converted in the quantization parameter region. As a result, it is possible to perform parameter conversion with less analytical error and less decline in sound quality in comparison with a case where reproduced speech is subjected to LPC analysis and pitch analysis again.

Further, in accordance with the present invention, reproduced speech is not subjected to LPC analysis and pitch analysis again. This solves the problem of prior art 1, namely the problem of delay ascribable to code conversion.

In accordance with the present invention, the arrangement is such that a target signal is created from reproduced speech in regard to algebraic code and algebraic codebook gain code, and the conversion is made so as to minimize the error between the target signal and algebraic synthesis signal. As a result, a code conversion with little decline in sound quality can be performed even in a case where the structure of the algebraic codebook in encoding scheme 1 differs greatly from that of the algebraic codebook in encoding scheme 2. This is a problem that could not be solved in prior art 2.

Further, in accordance with the present invention, voice code can be converted between the G.729A encoding scheme and the EVRC encoding scheme.

Furthermore, in accordance with the present invention, normal code components that have been demultiplexed are used to output dequantized values if transmission-path error has not occurred. If an error develops in the transmission path, normal code components that prevail in the past are used to output dequantized values. As a result, a decline in sound quality ascribable to channel error is reduced and it is possible to provide excellent reproduced speech after conversion.

As many apparently widely different embodiments of the present invention can be made without departing from the spirit and scope thereof, it is to be understood that the invention is not limited to the specific embodiments thereof except as defined in the appended claims.

What is claimed is:

1. A voice code conversion method of a voice code conversion apparatus for converting a first voice code, which has been obtained by encoding a voice signal by an LSP code, pitch-lag code, algebraic code, pitch-gain code and algebraic codebook gain code based upon a first voice encoding scheme, to a second voice code based upon a second voice encoding scheme, comprising the steps of:

inputting the first voice code obtained by encoding, in accordance with the first voice encoding scheme, a voice signal that has been produced by a user on a transmitting side to the voice code conversion apparatus;

discriminating, at a rate discriminator, whether the first voice code is obtained by encoding the voice signal at a first encode rate or at a second encode rate which is later than the first encode rate;

(A) in a case where the first voice code is obtained by encoding the voice signal at the first encode rate and the first voice code includes the pitch-lag code:

dequantizing, at dequantizers, each of the codes constituting the first voice code of a current frame to obtain dequantized values, quantizing, at quantizers, the dequantized values of the LSP code and pitch-lag code among these dequantized values by the second voice encoding scheme, and finding an LSP code and pitch-lag code of the second voice code;

storing said pitch-lag code of the second voice code in a pitch-lag buffer;

finding, at a pitch-gain interpolator, a dequantized value of a pitch-gain code of the second voice code by interpolation processing using the dequantized value of the pitch-gain code of the first voice code;

reproducing, at a speech reproduction unit, a voice signal from the first voice code;

generating, at a target generator, a pitch-periodicity synthesis signal using the dequantized values of the LSP code, pitch-lag code and pitch gain of the second voice code, and generating, as a target signal, a difference signal between the reproduced voice signal and pitch-periodcity synthesis signal;

generating, at an algebraic code converter, an algebraic synthesis signal using any algebraic code in the second voice encoding scheme and the dequantized value of the LSP code of the second voice code, and finding an algebraic code in the second voice encoding scheme that will minimize the difference between the target signal and the algebraic synthesis signal;

finding, at a gain converter, a gain code of the second voice code, which is a combination of pitch gain and algebraic codebook gain, by the second voice encoding scheme using the dequantized values of the LSP code and pitch-lag code of the second voice code, the algebraic code that has been found and the target signal; and multiplexing, at a code multiplexer, the found LSP code, pitch-lag code, algebraic code and gain code in the second voice encoding scheme and outputting a multiplexed result; and (B) in a case where the first voice code is obtained by encoding the voice signal at the second encode rate and the first voice code does not include the pitch-lag code:

dequantizing, at dequantizers, the LSP code and gain code constituting the first voice code of the current frame to obtain dequantized values, quantizing, at a LSP quantizer, the dequantized values of the LSP code among these dequantized values by the second voice encoding scheme, and finding an LSP code of the second voice code;

generating a noise signal by a noise generator, multiplying the noise signal by said dequantized values of the gain code by a gain multiplexer, and inputting the product to an LPC synthesis filter to create a target signal;

inputting the target signal and the LSP code of the second voice code to an algebraic code converter to find an algebraic code in the second voice encoding scheme;

finding, at a gain converter, a gain code of the second voice code, which is a combination of pitch gain and algebraic codebook gain, by the second voice encoding scheme using the LSP code of the second voice code, the algebraic code that has been found, the target signal and the pitch-lag code stored in said pitch-lag buffer; and multiplexing, at a code multiplexer, the found LSP code, pitch-lag code, algebraic code and gain code in the second voice encoding scheme, and outputting a multiplexed result.

* * * * *